US007967002B2

(12) United States Patent
Inada et al.

(10) Patent No.: US 7,967,002 B2
(45) Date of Patent: Jun. 28, 2011

(54) COOKING UTENSIL AND COOKING METHOD

(75) Inventors: Ikuhiro Inada, Nara (JP); Hideko Akashi, Nara (JP); Masato Matsuda, Nara (JP)

(73) Assignee: Panasonic Corporation, Osaka (JP)

( * ) Notice: Subject to any disclaimer, the term of this patent is extended or adjusted under 35 U.S.C. 154(b) by 1030 days.

(21) Appl. No.: 10/597,793

(22) PCT Filed: Feb. 8, 2005

(86) PCT No.: PCT/JP2005/001822

§ 371 (c)(1),
(2), (4) Date: Aug. 8, 2006

(87) PCT Pub. No.: WO2005/075892

PCT Pub. Date: Aug. 18, 2005

(65) Prior Publication Data

US 2008/0149088 A1 Jun. 26, 2008

(30) Foreign Application Priority Data

Feb. 10, 2004 (JP) ..... 2004-033411

(51) Int. Cl.
*F24D 1/00* (2006.01)
*B60H 3/00* (2006.01)
*H05B 6/64* (2006.01)

(52) U.S. Cl. ..... 126/21 A; 126/19 R; 126/20; 126/21 R; 99/330; 99/468; 99/475; 219/401

(58) Field of Classification Search ..... 126/20, 126/20.1, 21 A, 21 R, 285 A, 285 B, 290, 126/369, 369.2, 19 R, 273, 337 R; 219/400, 219/401; 99/330, 468, 474, 475, 476
See application file for complete search history.

(56) References Cited

U.S. PATENT DOCUMENTS

| | | | | | |
|---|---|---|---|---|---|
| 252,887 | A | * | 1/1882 | Marsh | 126/21 R |
| 495,027 | A | * | 4/1893 | Dengel | 126/3 |
| 599,225 | A | * | 2/1898 | Dimmock | 126/65 |
| 707,188 | A | * | 8/1902 | Walker | 126/15 R |
| 2,309,295 | A | * | 1/1943 | Barnes | 236/15 R |

(Continued)

FOREIGN PATENT DOCUMENTS

| | | |
|---|---|---|
| EP | 1 215 444 A1 | 6/2002 |
| EP | 1 239 229 A1 | 9/2002 |

(Continued)

OTHER PUBLICATIONS

Chinese Office action with English translation.

(Continued)

*Primary Examiner* — Steven B McAllister
*Assistant Examiner* — Daniel E Namay
(74) *Attorney, Agent, or Firm* — Pearne & Gordon LLP

(57) ABSTRACT

It is an object of the invention to provide a cooking device and a cooking method which can quickly discharge a steam supplied into a heating chamber from the heating chamber and can cook an object to be heated through uniform steam heating by setting the steam in the heating chamber to have a suitable temperature for the cooking.

A cooking device (100) for supplying a steam S to a heating chamber (11) accommodating an object M to be heated, thereby heating the object M to be heated includes steam supplying means for supplying the steam (S) to the heating chamber (11), and air discharging means for discharging the steam supplied to the heating chamber (11) from the heating chamber (11).

10 Claims, 16 Drawing Sheets

U.S. PATENT DOCUMENTS

| | | | | | |
|---|---|---|---|---|---|
| 2,861,860 | A | * | 11/1958 | Zaidan | 312/325 |
| 3,717,138 | A | * | 2/1973 | Upp | 126/200 |
| 4,149,518 | A | * | 4/1979 | Schmidt et al. | 126/190 |
| 4,163,894 | A | * | 8/1979 | Scherer | 219/391 |
| 4,290,552 | A | * | 9/1981 | Prikkel, III | 236/1 G |
| 4,294,226 | A | * | 10/1981 | Feinberg | 126/286 |
| 4,413,613 | A | * | 11/1983 | Dunlap | 126/292 |
| 4,426,923 | A | * | 1/1984 | Ohata | 99/468 |
| 4,627,409 | A | * | 12/1986 | Kagomoto | 126/21 A |
| 4,648,377 | A | * | 3/1987 | Van Camp | 126/21 A |
| 4,700,685 | A | * | 10/1987 | Miller | 126/20 |
| 4,771,163 | A | * | 9/1988 | Thiboutot | 219/400 |
| 4,780,596 | A | * | 10/1988 | Matsushima et al. | 219/400 |
| 4,791,909 | A | * | 12/1988 | Kalthoff | 126/21 A |
| 4,813,398 | A | * | 3/1989 | Savage | 126/21 A |
| 5,468,940 | A | * | 11/1995 | Kang | 219/746 |
| 5,549,038 | A | * | 8/1996 | Kolvites | 99/330 |
| 5,662,029 | A | | 9/1997 | Ubert et al. | |
| 5,802,963 | A | * | 9/1998 | Cohn et al. | 99/476 |
| 6,070,517 | A | * | 6/2000 | Helm | 99/330 |
| 6,234,161 | B1 | * | 5/2001 | Levi et al. | 126/21 R |
| 6,278,098 | B1 | * | 8/2001 | Han et al. | 219/681 |
| 6,323,464 | B1 | * | 11/2001 | Cohn | 219/401 |
| 6,350,965 | B2 | * | 2/2002 | Fukushima et al. | 219/401 |
| 6,545,251 | B2 | * | 4/2003 | Allera et al. | 219/394 |
| 6,564,792 | B2 | * | 5/2003 | Bassoli et al. | 126/21 A |
| 6,595,199 | B1 | * | 7/2003 | Andersen et al. | 126/77 |
| 6,734,403 | B2 | * | 5/2004 | Baker et al. | 219/486 |
| 6,837,234 | B2 | * | 1/2005 | Rabas et al. | 126/21 A |
| 6,854,457 | B2 | * | 2/2005 | Rabas et al. | 126/21 A |
| 6,861,631 | B2 | * | 3/2005 | Hahm et al. | 219/682 |
| 6,987,246 | B2 | * | 1/2006 | Hansen et al. | 219/401 |
| 6,992,268 | B2 | * | 1/2006 | Kim | 219/401 |
| 2001/0032549 | A1 | * | 10/2001 | Fukushima et al. | 99/476 |
| 2003/0230569 | A1 | * | 12/2003 | Kanzaki et al. | 219/682 |

FOREIGN PATENT DOCUMENTS

| | | | | |
|---|---|---|---|---|
| FR | 2 699 650 | A1 | | 6/1994 |
| JP | 63254320 | | | 10/1988 |
| JP | 63311026 | A | * | 12/1988 |
| JP | 641302 | | | 1/1989 |
| JP | 07-133932 | A | | 5/1995 |
| JP | 07-139741 | A | | 5/1995 |
| JP | 08061676 | A | * | 3/1996 |
| JP | 08135979 | A | * | 5/1996 |
| JP | 08135980 | A | * | 5/1996 |
| JP | 08-178298 | A | | 7/1996 |
| JP | 09-089260 | A | | 4/1997 |
| JP | 09-126460 | A | | 5/1997 |
| JP | 09-210367 | A | | 8/1997 |
| JP | 09-511326 | A | | 11/1997 |
| JP | 2001-263667 | | | 9/2001 |
| JP | 2007271104 | A | * | 10/2007 |

OTHER PUBLICATIONS

European Search Report for EP 05 70 9874 dated Aug. 18, 2010.

* cited by examiner (F1)

(F2)

COOKING UTENSIL AND COOKING METHOD

TECHNICAL FIELD

The present invention relates to a cooking device and a cooking method which supplies a steam to a heating chamber, thereby carrying out cooking.

BACKGROUND ART

In the case in which a food is cooked by the high frequency heating of a microwave oven, conventionally, there is a drawback that a steam is generated from the food by the heating and a window glass of an opening door of a heating chamber is steamed up by the steam, and the state of progress of the cooking cannot be confirmed. As a countermeasure, there is widely employed a structure in which a wind supplied from an air supply port into the heating chamber is blown against the window glass of the opening door. For the wind at this time, in the case in which the outside air is directly introduced and blown against, a temperature in the heating chamber is greatly reduced. For this reason, warm air obtained after cooling a magnetron is used. Moreover, the steam generated from the food rises in a close position to the window glass of the opening door. Therefore, the air supply port is provided above the heating chamber which is close to the opening door and the wind is blown against the window glass from above. Moreover, an air discharge port for discharging the wind supplied from the air supply port is also provided in the heating chamber.

In the oven heating, however, the function of introducing the wind and discharging the steam through the air supply port and the air discharge port turns the air out of the heated inside of the heating chamber so that a heating efficiency is reduced. For this reason, there is required such a device that positions in which the air supply port and the air discharge port are to be disposed are changed or a shutter is provided in the middle of a passage. In order to reduce a cost, generally, the position in which the air discharge port is to be disposed is taken as the countermeasure, and the air discharge port is often disposed near a lower part on the inner side of the heating chamber. At present, thus, there is widely used a microwave oven with an oven function having a structure in which an air supply port and an air discharge port are provided in upper and lower parts of a side wall surface of a heating chamber.

By adding a steam generating function to the microwave oven of this type, it is possible to execute high frequency heating and steam heating at the same time or independently. In case of cooking in which the steam heating is mainly carried out, it is important that a suitable temperature for a food is ideally maintained in a state in which a steam density is approximately 100% (for example, 80° C. in case of an egg, 98° C. in case of a meat bun and 100° C. or more in case of a steamed potato) in order to successfully carry out cooking rapidly and reliably.

In a special steamer for steam cooking, a large amount of water is boiled to raise a steam density. By a structure in which a heating chamber is vertically divided by a dividing plate (a tray for mounting a food) in order to raise the steam density, thereby forming small spaces on the upper side of the heating chamber and supplying a steam to the spaces on the upper side in the microwave oven, however, it is possible to heat an object to be heated in a state in which the steam density is increased.

For example, Patent Document 1 has disclosed a steam cooking device for regulating a steam partial pressure (a volume ratio of occupation of the steam) in the heating chamber to set an atmospheric temperature in the heating chamber when carrying out cooking in which an accurate temperature management is important for the cooking as in egg cooking.

Patent Document 1: JP-A-63-254320 Publication

DISCLOSURE OF THE INVENTION

Problems to be Solved

In some cases, however, the steam supplied once to the heating chamber is always unnecessary during cooking depending on the cooking contents of a food. In those cases, the steam remaining in the heating chamber sometimes has a bad influence on the result of the food. How to quickly discharge the steam which is not necessary for the cooking is a problem.

In the case in which the steam is supplied to heat an object to be heated, moreover, the supplied steam is collected into an upper part of the heating chamber. If an air discharge port for air discharge is provided therein, the steam gets out of the heating chamber through the air discharge port. If an air supply port for taking outside air in is provided in the upper part of the heating chamber, similarly, the steam gets out of the air supply port when the air supply is stopped. In some cases in which the steam gets out of the air discharge port or the air supply port, a dew is generated in an air supply path, resulting in an insanitary situation, and furthermore, the dew drops onto electronic components of an apparatus to cause a short circuit. When the outside air is supplied from the air supply port, furthermore, the steam collected into the upper part of the heating chamber with much trouble gets out at a time.

In order to solve such a problem, therefore, it is possible to propose a structure in which an air supply port and an air discharge port are provided in a lower part of the heating chamber to supply the steam from the upper side of the heating chamber in an upper part of the dividing plate. With the structure, however, the steam is directly supplied from very close quarters of the object to be heated which is mounted on the dividing plate so that there is a tendency that a nonuniform temperature distribution is presented, that is, the steam is blown against the object to be heated so that a temperature of the object to be heated is raised locally.

For example, in the case in which approximately four to six pot-steamed hotchpotches 202 (202A, 202B) are mounted as objects to be heated on a tray 203 in a heating chamber 201 and are cooked at the same time as shown in FIG. 16, a steam S at approximately 100° C. is blown against the pot-steamed hotchpotch 202A which is close to a steam supply port 204 and is thus brought into an overheating state, while the pot-steamed hotchpotch 202B which is distant from the steam supply port 204 is brought into an insufficient heating state so that an unevenness is easily generated depending on places where they are disposed.

Also in the case in which the steam S supplied to the heating chamber 201 is discharged, moreover, an air supply port and an air discharge port are present in a lower space 201B of the heating chamber. For this reason, there is a possibility that the steam S might stay in only an upper space 201A of the heating chamber, resulting in a reduction in a ventilation efficiency.

When the pot-steamed hotchpotch 202 is to be cooked by oven heating for circulating hot air at a high temperature into the heating chamber 201 as shown in FIG. 17, furthermore, a longer time than that in the case in which the cooking is carried out by the steam heating is required and a finishing state is not desirable. In other words, when the cooking is carried out by setting a finishing temperature to be approximately 96° C. to 98° C. in a state in which a heating temperature is set to be 150° C. (F1), an approximately double time is required as compared with a time in the case in which the cooking is carried out by the steam heating (F0) (see FIG. 7). In addition, referring to a finishing state, a peripheral portion 205*a* of a vessel 206 is brought into a bubble state as shown in FIG. 18 in case of F1. On the other hand, when a finishing temperature is set to be low, for example, approximately 70° C. to 75° C. to carry out the cooking (F2), a central part 205*b* is not hardened as shown in FIG. 19 so that the heating is insufficient. In the oven heating, thus, the heating is carried out by setting air to be a heat transfer medium. For this reason, there is a limit to increase the amount of a heat transfer to the object 202 to be heated. In many cases, consequently, a great temperature difference is generated on a surface and an inner part of the object 202 to be heated so that the object 202 to be heated is hard to heat quickly and uniformly.

In the cooking device according to the Patent Document 1, an atmospheric temperature in the heating chamber is set to be lower than 100° C., for example, 90° C. by mixing the outside air with a steam at 100° C. However, the outside air is introduced through a hole (an outside air communicating portion) provided in a part of the heating chamber, and the steam is only diffused with the rising action of the supplied steam. Therefore, the diffusion effect is actually small so that a sufficient diffusing state is obtained with difficulty. Accordingly, the inner part of the heating chamber cannot be set to have a desirable atmospheric temperature rapidly and accurately.

In consideration of the situations, it is an object of the invention to provide a cooking device and a cooking method which can quickly discharge, from a heating chamber, a steam supplied into the heating chamber and can cook an object to be heated with uniform steam heating by setting the steam in the heating chamber to have a suitable temperature for cooking.

Means for Solving the Problems

A cooking device according to a first aspect of the invention serves to supply a steam into a heating chamber accommodating an object to be heated, thereby heating the object to be heated, and comprises steam supplying means for supplying the steam to the heating chamber, and air discharging means for discharging the steam supplied to the heating chamber from the heating chamber.

According to the cooking device, the steam is supplied into the heating chamber and the steam thus supplied can be quickly discharged by the air discharging means.

The cooking device according to a second aspect of the invention is characterized in that the air discharging means includes ventilating means for sucking outside air and generating a wind, a ventilating path for air supply which serves to lead the wind from the ventilating means to the heating chamber, a ventilating path for air discharge which serves to discharge air in the heating chamber, and a control portion for controlling an amount of supply of the outside air to the heating chamber.

According to the cooking device, the steam is supplied into the heating chamber, while the wind sent from the ventilating means is introduced into the heating chamber through the ventilating path for air supply, and furthermore, the air in the heating chamber is discharged from the ventilating path for air discharge. Therefore, the steam supplied into the heating chamber is positively stirred through the outside air so that an inner part of the heating chamber can be set to have a desirable steam density. In other words, a mixed gas in which the steam is sufficiently diffused into the air in the heating chamber is generated. The mixed gas has a temperature which is lower than the temperature of the supplied steam. Accordingly, it is possible to set the heating chamber to have an optional temperature which is suitable for cooking. Thus, cooking such as egg cooking which requires accurate temperature setting can be carried out rapidly and reliably.

The cooking device according to a third aspect of the invention is characterized by an air supply side shutter for limiting a flow rate of passage on an upstream side of a passageway from a connecting position to the heating chamber in the ventilating path for air supply.

According to the cooking device, the air supply side shutter is provided on the upstream side of the passageway of the ventilating path for air supply. Consequently, it is possible to freely change the flow rate of the ventilating path for air supply and to vary the amount of supply of the outside air into the heating chamber.

The cooking device according to a fourth aspect of the invention is characterized by an air discharge side shutter for limiting a flow rate of passage on a downstream side of the passageway from a connecting position to the heating chamber in the ventilating path for air discharge.

According to the cooking device, the air discharge side shutter is provided on the downstream side of the passageway of the ventilating path for air discharge. Consequently, it is possible to freely change the flow rate of the ventilating path for air discharge and to vary the amount of discharge of the air from the heating chamber.

The cooking device according to a fifth aspect of the invention is characterized in that the shutter is selectively held in either an opening state or a shielding state of the passageway.

According to the cooking device, opening and closing controls can be carried out with a simple structure. By a duty control of opening and closing operations, it is possible to finely set a temperature and a steam density in the heating chamber.

The cooking device according to a sixth aspect of the invention is characterized in that the shutter can optionally set a degree of opening of the passageway.

According to the cooking device, it is possible to optionally set the flow rate of a gas flowing in the passageway and to finely set the temperature and the steam density in the heating chamber.

The cooking device according to a seventh aspect of the invention is characterized by a dividing plate for vertically dividing a space in the heating chamber, a communicating portion for connecting the upper and lower spaces being formed between the heating chamber and the dividing plate and the steam supplying means supplying a steam from the lower space of the heating chamber.

According to the cooking device, the dividing plate for vertically dividing the heating chamber is provided to supply the steam to the lower space formed below the dividing plate. Consequently, the steam supplied to the lower space rises and collects into an upper space through the communicating portion. By this action, the steam is promoted to be stirred so that the steam density in the upper space of the heating chamber is caused to be uniform.

The cooking device according to an eighth aspect of the invention is characterized in that an air supply port through which the ventilating path for air supply is connected to the heating chamber is provided in the lower space of the heating chamber.

In the cooking device, the air supply port is provided in the lower space of the heating chamber. Therefore, the outside air which is sent is efficiently stirred with the steam supplied to the same lower space so that a uniform mixed gas is obtained.

The cooking device according to a ninth aspect of the invention is characterized in that an air discharge port through which the ventilating path for air discharge is connected to the heating chamber is provided in the lower space of the heating chamber.

In the cooking device, the air discharge port is provided in the lower space of the heating chamber. Therefore, it is possible to prevent the air in the upper space from being suddenly replaced. Thus, it is possible to discharge the air without a hindrance to the steam heating.

A cooking method according to a tenth aspect of the invention serves to supply a steam to a heating chamber accommodating an object to be heated, thereby heating the object to be heated, and comprises a heating step of heating the object to be heated while supplying the steam to the heating chamber, and a steam discharging step of discharging the steam remaining in the heating chamber after the heating from the heating chamber.

According to the cooking method, the object to be heated is heated while the steam is supplied to the heating chamber at the heating step, and the steam remaining in the heating chamber is then discharged from the heating chamber at the steam discharging step. Consequently, it is possible to quickly discharge the steam in the heating chamber.

The cooking method according to an eleventh aspect of the invention is characterized in that outside air is sent into the heating chamber and air in the heating chamber is discharged, and the steam supplied to the heating chamber is stirred.

According to the cooking method, the outside air is introduced into the heating chamber, and furthermore, the air in the heating chamber is discharged. Therefore, the steam supplied into the heating chamber is positively stirred by the outside air so that the inner part of the heating chamber can be caused to have a desirable steam density. In other words, a mixed gas in which the steam is sufficiently diffused into the air in the heating chamber is generated. The mixed gas has a temperature which is lower than the temperature of the supplied steam. Accordingly, it is possible to set the heating chamber to have an optional temperature which is suitable for the cooking and cooking such as egg cooking which requires accurate temperature setting can be carried out rapidly and reliably.

Advantage of the Invention

According to the cooking device and the cooking method in accordance with the invention, a steam supplied into a heating chamber can be quickly discharged from the heating chamber, and furthermore, an object to be heated can be cooked by uniform steam heating by setting the steam in the heating chamber to have a suitable temperature for the cooking.

EXPLANATION OF THE DESIGNATION

Figure 1:
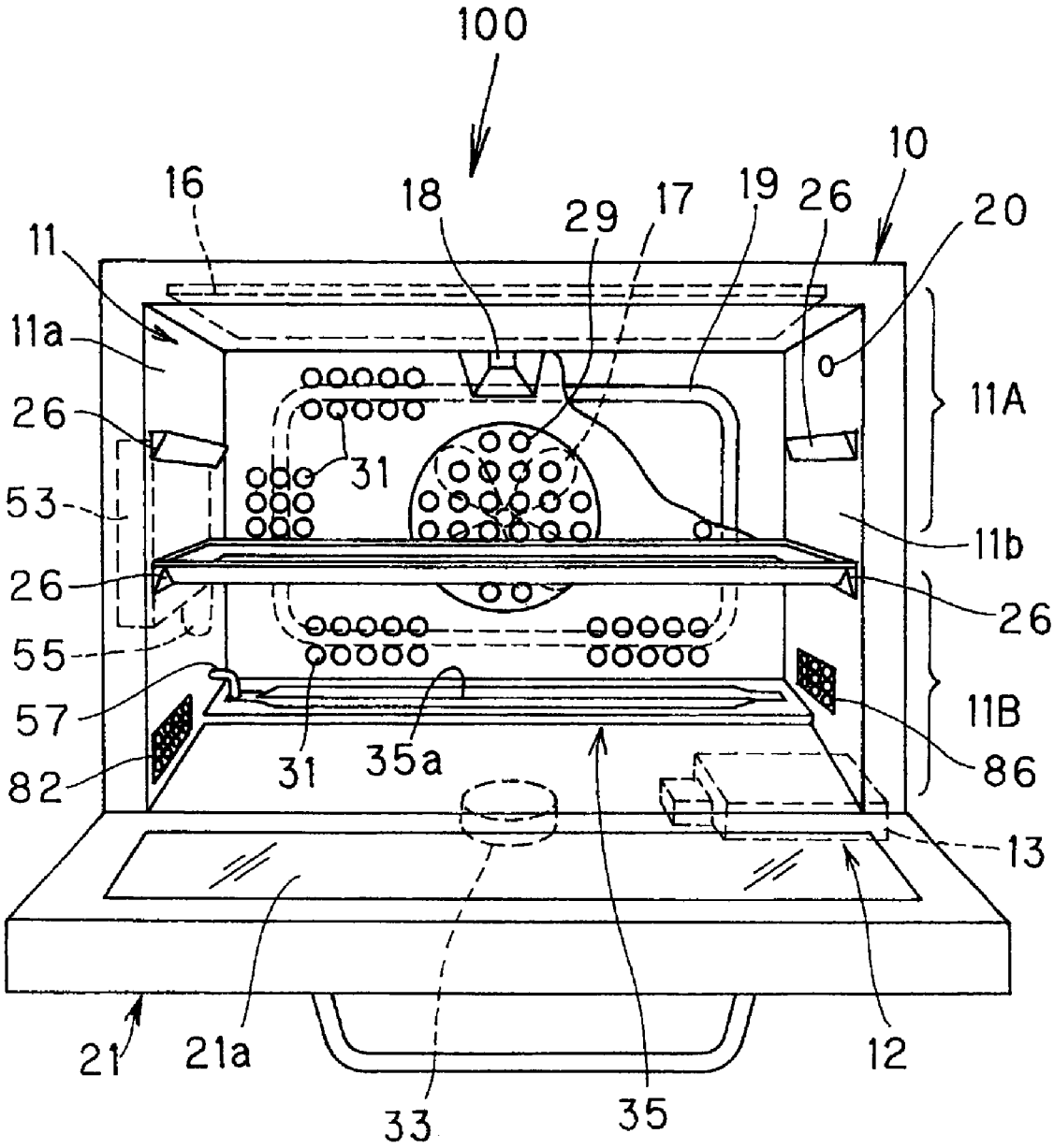
FIG. 1 is a front view showing a state in which an opening door of a cooking device according to the invention is opened.

11 heating chamber
11A upper space of heating chamber
11B lower space of heating chamber
15 steam supplying portion (steam supplying means)
22, 40, 41 tray for mounting object to be heated (dividing plate)
32 cooling fan (ventilating means)
35 evaporating dish
37 evaporating dish heater (evaporating dish heating means)
51 air supply side shutter
52 air discharge side shutter
60 ventilating fan (ventilating means)
81 ventilating path for air supply
82 air supply port
85 ventilating path for air discharge
86 air discharge port
90 pot-steamed hotchpotch (object to be heated)
100 cooking device
501 control portion
M object to be heated
S steam

BEST MODE FOR CARRYING OUT THE INVENTION

A preferred embodiment of a cooking device according to the invention will be described below in detail with reference to the drawings.

Figure 2:
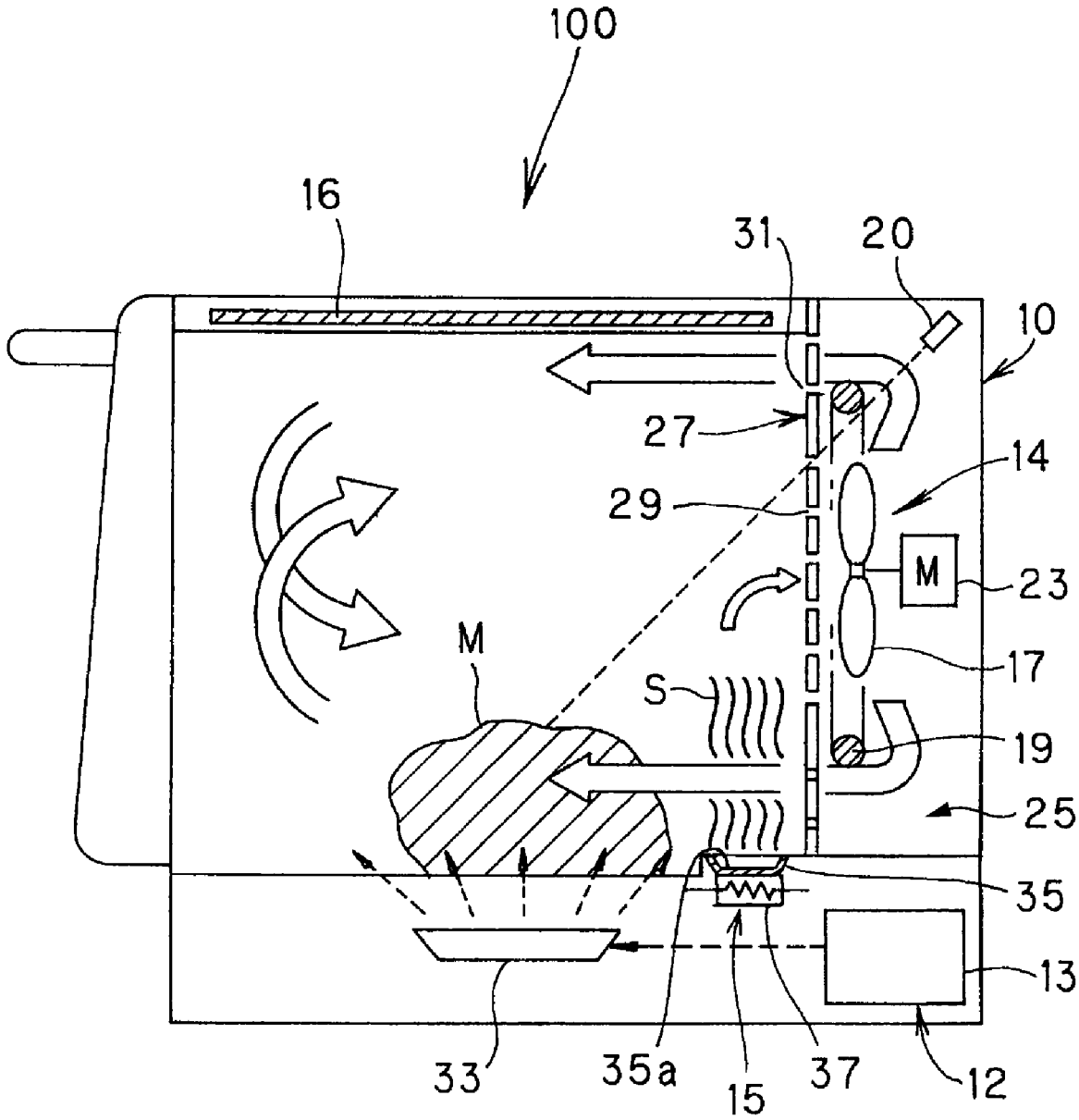
FIG. 2 is an explanatory view showing a basic operation of the cooking device.
Figure 3:
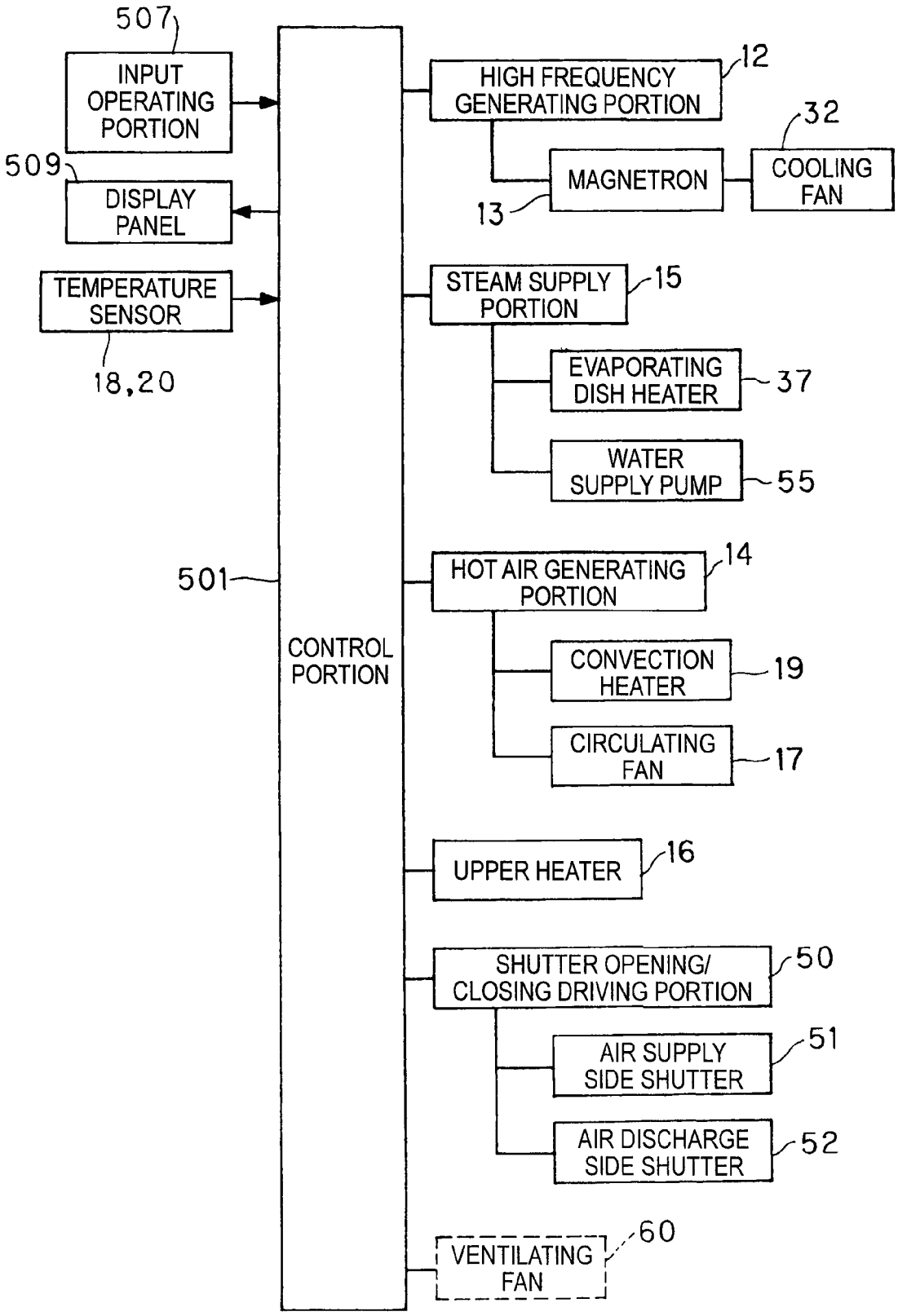
FIG. 3 is a block diagram showing a control system of the cooking device.

FIG. 1 is a front view showing a state in which an opening door of the cooking device according to the invention is opened, FIG. 2 is an explanatory view showing a basic operation of the cooking device, and FIG. 3 is a block diagram showing a control system for controlling the cooking device.

A cooking device 100 serves to supply at least one of a high frequency (microwave) and a steam S to a heating chamber 11 for accommodating an object to be heated and to heat the object to be heated, and comprises a magnetron 13 to be a high frequency generating portion 12 for generating a high frequency, a steam supplying portion 15 for generating the steam S in the heating chamber 11, an upper heater 16 disposed in an upper part of the heating chamber 11, a circulating fan 17 for stirring and circulating air in the heating chamber 11, a convection heater 19 to be an indoor air heater for heating the air circulated in the heating chamber 11, an infrared sensor 18 to be a temperature sensor for measuring a temperature in the heating chamber 11 through a detecting hole provided on a wall surface of the heating chamber 11, a thermistor 20 disposed on the wall surface of the heating chamber 11 and serving to measure a temperature of an object M to be heated, and a tray 22 for mounting an object to be heated which serves as a dividing plate disposed removably above at a predetermined interval from a bottom face of the heating chamber 11 and serving to vertically divide the heating chamber 11.

As shown in FIGS. 1 and 2, the heating chamber 11 is formed in a body case 10 taking the shape of a box in which a front face is opened, and an opening door 21 having a transparent window 21*a* for opening and closing a port for taking out the heated object in the heating chamber 11 is provided on a front face of the body case 10. The opening door 21 has a lower end coupled to a lower edge of the body case 10 through a hinge and can be thus opened and closed in a vertical direction. A predetermined insulating space is maintained between the wall surfaces of the heating chamber 11 and the body case 10, and an insulator is provided in the space if necessary.

The magnetron 13 is disposed in a lower space of the heating chamber 11, for example, and a stirrer blade 33 (or a rotating antenna) to be electric wave stirring means is provided in a position in which a high frequency generated by the magnetron 13 is received. The high frequency generated from the magnetron 13 is irradiated on the rotating stirrer blade 33 and is thus stirred and supplied into the heating chamber 11 by means of the stirrer blade 33. The magnetron 13 and the stirrer 33 can also be provided on an upper surface and a side surface side of the heating chamber 11 in addition to the bottom part of the heating chamber 11.

As shown in FIG. 2, a circulating fan chamber 25 accommodating a circulating fan 17 and a driving motor 23 thereof is disposed in a space on the back of the heating chamber 11, and a rear wall of the heating chamber 11 serves as an inner side wall surface 27 for forming the heating chamber 11 and the circulating fan chamber 25. The inner side wall surface 27 is provided with a ventilating hole 29 for air suction which serves to suck air from the heating chamber 11 side to the circulating fan chamber 25 side and a ventilating hole 31 for ventilation which serves to send the air from the circulating fan chamber 25 side to the heating chamber 11 side with a distinction of forming areas. The ventilating holes 29 and 31 are formed as a large number of punch holes.

A hot air generating portion 14 is constituted by the circulating fan 17 and the convection heater 19. More specifically, the circulating fan 17 is disposed in almost a central position of the rectangular inner side wall surface 27. In the circulating fan chamber 25, the rectangular ring-shaped convection heater 19 is provided to surround the circulating fan 17. The ventilating hole 29 for air suction which is formed on the inner side wall surface 27 is disposed on a front face of the circulating fan 17 and the ventilating hole 31 for ventilation is disposed in a position along the rectangular ring-shaped convection heater 19.

When the circulating fan 17 is rotated and driven, a generated wind flows from the front surface side of the circulating fan 17 to a rear side where a driving motor 23 is provided. Consequently, the air in the heating chamber 11 is sucked into a central position of the convection heater 19 where the circulating fan 17 is provided through the ventilating hole 29 for air suction and is diffused radially, and passes through the vicinity of the convection heater 19 and is thus heated, and is then fed from the ventilating hole 31 for ventilation into the heating chamber 11. By the flow, accordingly, the air in the heating chamber 11 is stirred and, at the same time, is circulated through the circulating fan chamber 25.

As shown in FIG. 2, the steam supplying portion 15 is constituted to include an evaporating dish 35 having a water reservoir concave portion 35*a* for generating the steam S by heating and an evaporating dish heater 37 disposed under the evaporating dish 35 and serving to heat the evaporating dish 35. The evaporating dish 35 is obtained by forming a concave portion on a plate member formed of stainless and takes a long and slender shape, for example, and is disposed on a bottom face at an inner side which is opposite to a heated object outlet of the heating chamber 11 with a longitudinal direction set along the inner side wall surface 27. The evaporating dish heater 37 is not shown and has such a structure that a heat block formed by aluminum die casting in which a heat generating member such as a sheath heater is buried is provided in contact with the evaporating dish 35. In addition, the evaporating dish 35 may be heated with a radiant heat through a glass tube heater or a sheath heater, and a plate heater may be stuck to the evaporating dish 35.

As shown in FIG. 1, moreover, a water storage tank 53 for storing water to be supplied to the evaporating dish 35, a water feeding pump 55 and a water supply conduit 57 having a discharge port disposed opposite to the evaporating dish 35 are provided in the body case 10. The water stored in the water storage tank 53 is properly supplied in a desirable amount to the evaporating dish 35 through the water supply conduit 57. The water storage tank 53 is buried to be compact in a side wall portion of the body case 10 which is comparatively hard to have a high temperature in such a manner that the apparatus itself is not large-sized when it is incorporated into the apparatus. The water storage tank 53 is removably attached by pulling from a side surface side of the body case 10 to the outside. In addition, the water storage tank 53 may be subjected to an insulating treatment and may be provided on an upper surface side of the apparatus or may be provided on a lower surface side.

The upper heater 16 is a plate heater such as a mica heater which carries out heating for grill cooking and preheats the heating chamber 11, and is disposed in the upper part of the heating chamber 11. Moreover, the upper heater 16 can also be constituted by a sheath heater in place of the plate heater. The thermistor 20 is provided on the wall surface of the heating chamber 11 and serves to detect a temperature in the heating chamber 11. The infrared sensor 18 capable of measuring temperatures in a plurality of places (for example, eight places) at the same time is further disposed rockably on the wall surface of the heating chamber 11. By a scan operation for rocking the infrared sensor 20, it is possible to measure temperatures on a plurality of measuring points in the heating chamber 11, and furthermore, to know a mounting position of the object M to be heated by monitoring the temperatures on the measuring points with the passage of time.

The tray 22 for mounting an object to be heated which serves as the dividing plate is removably supported on an engaging portion 26 formed on side wall surfaces 11*a* and 11*b* of the heating chamber 11. The engaging portion 26 is provided in a plurality of stages so as to freely support the tray 22 for mounting an object to be heated in a plurality of height positions of the heating chamber 11. By engaging the tray 22 for mounting an object to be heated with the engaging portion 26, the heating chamber 11 is divided into two parts, that is, an upper space 11A and a lower space 11B.

FIG. 3 is a block diagram showing a control system of the cooking device 100. The control system is constituted to mainly include a control portion 501 having a microprocessor, for example. The control portion 501 mainly transfers a signal together with an input operating portion 507, a display panel 509, a high frequency generating portion 12, a steam supplying portion 15, a hot air generating portion 14, an upper heater 16 and a shutter opening and closing driving portion 50 and controls each of these portions.

The input operating portion 507 includes various keys such as a start switch, a change-over switch of a heating method and an automatic cooking switch, and a key operation is properly carried out to perform cooking depending on the contents of the cooking while making a confirmation through the display panel 509.

A motor (not shown) for driving the magnetron 13 and the stirrer blade 33 is connected to the high frequency generating portion 12, and furthermore, a cooling fan 32 for magnetron cooling is also connected thereto. The evaporating dish heater 37 and the water feeding pump 55 are connected to the steam supplying portion 15, and the circulating fan 17 and the convection heater 19 are connected to the hot air generating portion 14. Moreover, an air supply side shutter 51 and an air discharge side shutter 52 are connected to the shutter opening and closing driving portion 50.

Next, description will be given to the basic operation of the cooking device 100.

As shown in FIG. 2, first of all, a food which is the object M to be heated is mounted on a plate and is put in the heating chamber 11, and the opening door 21 is closed. The input operating portion 507 is operated to variously set a heating method, a heating time and a heating temperature. When a start button is pressed down, cooking is automatically carried out by the operation of the control portion 501.

For example, in the case in which a mode of "steam generation+circulating fan ON" mode is selected, the evaporating dish heater 37 is turned ON so that the water in the evaporating dish 35 is heated and the steam S is generated. The steam S rising from the evaporating dish 35 is sucked into the central part of the circulating fan 17 from the ventilating hole 29 for air suction provided in almost the central part of the inner side wall surface 27 and is blown out of the ventilating hole 31 for ventilation provided on the peripheral part of the inner side wall surface 27 toward the inner part of the heating chamber 11 via the circulating fan chamber 25. The steam thus blown out is stirred in the heating chamber 11 and is sucked to the circulating fan chamber 25 side from the ventilating hole 29 for air suction in almost the central part of the inner side wall surface 27 again. Consequently, a circulating path is formed in the heating chamber 11 and the circulating fan chamber 25. As shown in an outlined arrow in the drawing, the steam S is circulated in the heating chamber 11 so that the steam is blown against the object M to be heated.

In this case, it is possible to heat the steam S in the heating chamber 11 by turning ON the convection heater 19. Therefore, it is possible to further set the temperature of the steam S circulated in the heating chamber 11 to be higher. Accordingly, a so-called overheat steam can be obtained and cooking giving a burn mark on the surface of the object M to be heated can also be carried out. In the case in which the high frequency heating is carried out, moreover, the magnetron 13 is turned ON to rotate the stirrer blade 33. Consequently, it is possible to uniformly stir and supply a high frequency into the heating chamber 11, thereby carrying out high frequency cooking having no unevenness.

As described above, by using the magnetron 13, the hot air generating portion 14, the steam supplying portion 15 and the upper heater 16 singly or in combination, the cooking device 100 can heat the object M to be heated (the food) by an optimum heating method for the cooking.

The temperature in the heating chamber 11 in the cooking is measured by the infrared sensor 18 and the thermistor 20, and the control portion 501 properly controls the magnetron 13, the upper heater 16 and the convection heater 19 based on the result of the measurement. When using the infrared sensor 18 capable of measuring the temperatures in a plurality of places (for example, eight places) at the same time, it is possible to measure the temperatures on the measuring points in the heating chamber 11 with high precision in a short time by rocking the infrared sensor 18 to scan the inside of the heating chamber 11. In some cases, the infrared sensor 18 does not measure an accurate temperature in the heating chamber 11 when the heating chamber 11 is filled with the steam S. In those cases, the temperature is measured by the thermistor 20.

Figure 4:
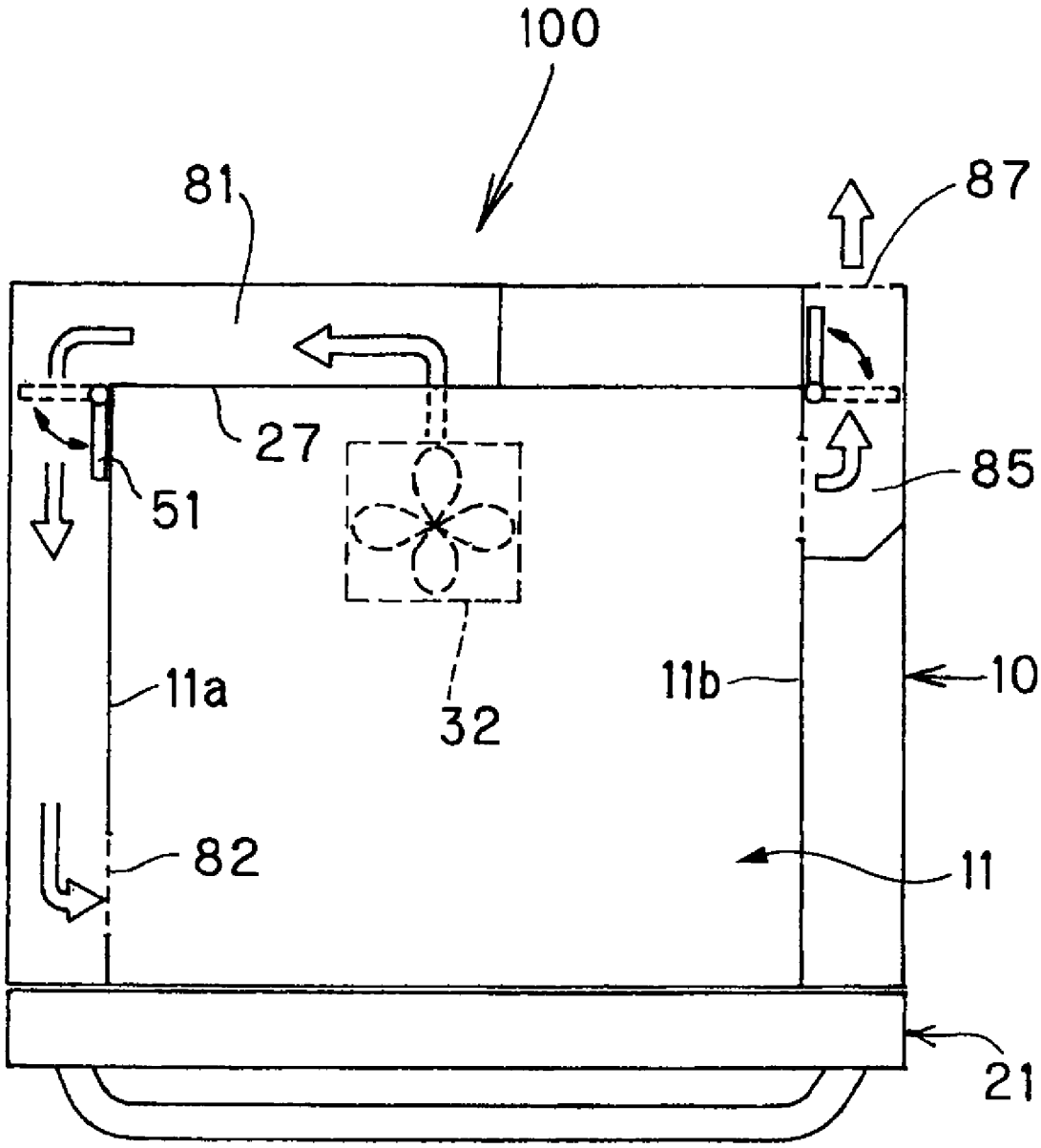
FIG. 4 is a plan view showing a schematic structure of an air supplying and discharging mechanism of the cooking device.

In addition to the basic components, as shown in FIG. 4, the cooking device 100 according to the invention includes a ventilating path 81 for air supply which serves to lead outside air to the heating chamber 11, a ventilating path 85 for air discharge which serves to discharge air in the heating chamber 11, the air supply side shutter 51 and the air discharge side shutter 52, and the shutter opening and closing driving portion 50 (see FIG. 3). In other words, there is employed such a structure as to include air discharging means for discharging, from the heating chamber 11, the steam supplied to the heating chamber 11.

As shown in FIGS. 1 and 4, in the cooking device 100 according to the embodiment, an air supply port 82 connected to the ventilating path 81 for air supply is provided in a lower part of the side wall surface 11*a* on the left side of the heating chamber 11 which is close to the opening door 21 and is opened to the lower space 11B of the heating chamber 11. Moreover, an air discharge port 86 is provided on a lower end of the side wall surface 11*b* on the right side of the heating chamber 11 at the inner side of the heating chamber 11 and is opened to the lower space 11B of the heating chamber 11.

The air supply port 82 communicates with the ventilating path 81 for air supply which is maintained between the outside surface of the body case 10 and the side wall surface 11*a* of the heating chamber 11 and between the outside surface of the body case 10 and the inner side wall surface 27, and the air supply side shutter 51 which is openable is provided in the middle of the ventilating path 81 for air supply. The wind sent from the cooling fan 32 for magnetron cooling which is provided integrally with the magnetron 13 is blown out of the air supply port 82 into the heating chamber 11 through the ventilating path 81 for air supply by switching the air supply side shutter 51.

The cooling fan 32 is not restricted to a fan for magnetron cooling but a ventilating fan 60 may be separately provided and used as shown in the block diagram of FIG. 3. In the case in which there is a possibility that the temperature in the heating chamber 11 might be quickly cooled when the outside air is directly supplied to the heating chamber 11 by means of the ventilating fan 60, heating means is attached to the ventilating fan 60 or the magnetron 13 is cooled by using the magnetron cooling fan 32, thereby supplying warm air to the heating chamber 11.

The air discharge port 86 communicates with the ventilating path 85 for air discharge which is maintained between the outside surface of the body case 10 and the side wall surface 11*b* of the heating chamber 11, and the openable discharge side shutter 52 is provided in the middle of the ventilating path 85 for air discharge. The ventilating path 85 for air discharge communicates with the outside through a discharge port 87. By opening the air discharge side shutter 52, it is possible to discharge the air in the heating chamber 11 to the outside with the air supply into the heating chamber 11.

The air supply side shutter 51 and the air discharge side shutter 52 are constituted by a damper which is always energized in one direction by means of a spring, for example, and the damper is rocked by an electromagnetic force so that the ventilating path 81 for air supply and the ventilating path 85 for air discharge can be selectively held in an opening or shielding state. Alternatively, it is also possible to employ a structure in which the damper is changed from a closing state to an opening state by a wind pressure. In this case, the shutter mechanism can further be simplified. In order to prevent the steam in the heating chamber 11 from suddenly getting out, the air supply side shutter 51 and the air discharge side shutter 52 are brought into the closing state when air supply and air discharge are not necessary.

The outside air sucked from the outside through the cooling fan 32 is blown from the air supply port 82 into the heating chamber 11 through the ventilating path 81 for air supply and the air supply side shutter 51. By the air supply from the air supply port 82, the air in the hearting chamber 11 is discharged from the air discharge port 86 to the outside through the ventilating path 85 for air discharge, the air discharge side shutter 52 and the discharge port 87. At this time, the air in the heating chamber 11 flows over almost a diagonal line of the heating chamber 11. Therefore, stirring and ventilation can be efficiently carried out.

Next, a steam heating function of the cooking device 100 according to the embodiment will be described with reference to FIG. 5.

Figure 5:
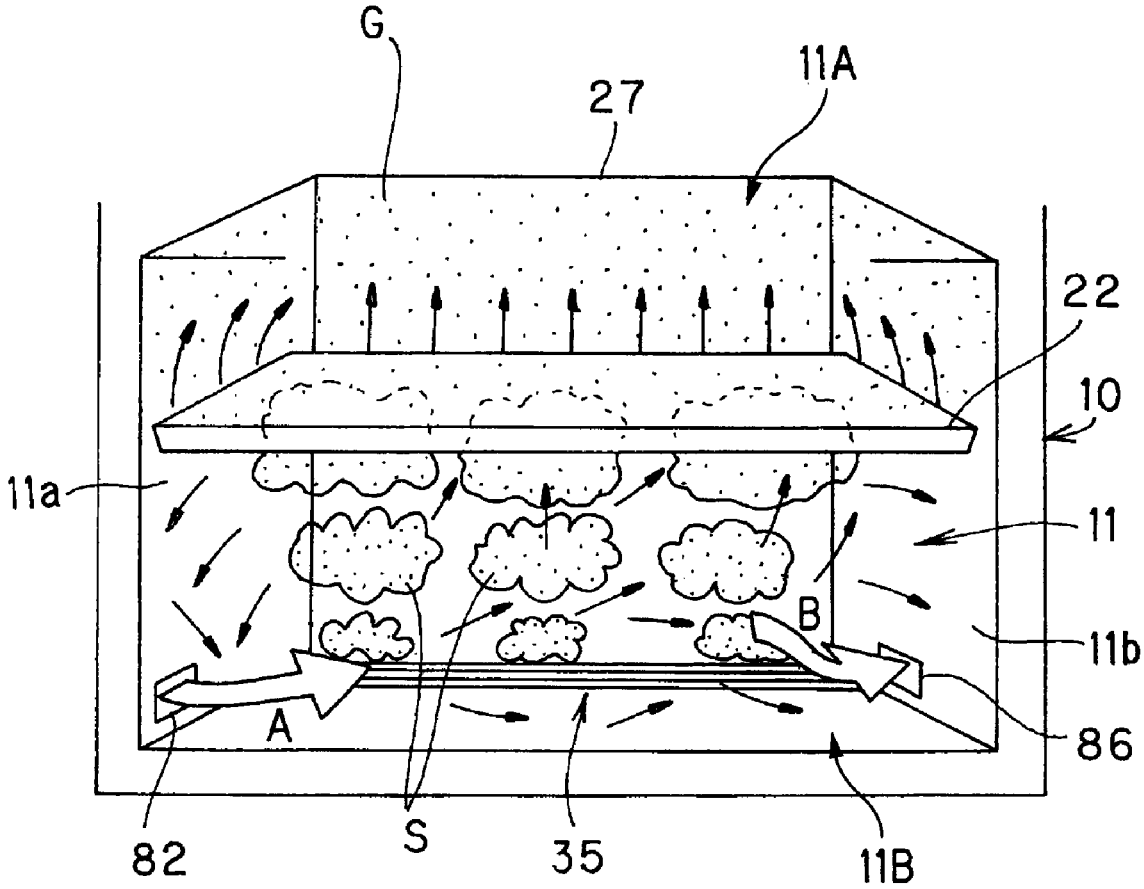
FIG. 5 is an explanatory view showing a state in which a steam supplied from a steam supplying portion is uniformly stirred in a lower space and is then collected into an upper space.

As shown in FIG. 5, when water is supplied from the water storage tank 53 to the evaporating dish 35 through the water feeding pump 55 and the evaporating dish heater 37 is then turned ON, the water of the evaporating dish 35 is heated so that the steam S is generated and is diffused into the lower space 11B of the heating chamber 11. At the same time, the air supply side shutter 51 and the air discharge side shutter 52 are brought into an opening state and the cooling fan 32 (or the ventilating fan 60) is operated to blow the outside air from the air supply port 82 into the heating chamber 11 in a direction of an arrow A. Consequently, the steam S filled in the lower space 11B of the heating chamber 11 is positively stirred by an air current sent from the air supply port 82, and furthermore, a part of the air in the lower space 11B of the heating chamber 11 is discharged from the air discharge port 86 through the ventilating path 85 for air discharge, the air discharge side shutter 52, and the discharge port 87 in a direction of an arrow B.

Since the heating chamber 11 is vertically divided into two parts through the tray 22 for mounting an object to be heated which serves as a dividing plate, an area is more reduced as compared with the case in which the tray 22 for mounting an object to be heated is not provided. Accordingly, the steam S generated in the lower space 11B is sufficiently stirred by the air blown from the air supply port 82 in the direction of the arrow A so that a mixed gas G having a uniform steam density is generated. The steam density implies an occupation density of the steam to a mixed gas of the steam generated from the evaporating dish 35 and the air. When the steam density is raised, an amount of presence per unit volume of the steam is increased. As a result, the temperature of the mixed gas G approximates to 100° C. To the contrary, when the steam density is reduced, the amount of presence per unit volume of the steam is decreased so that the temperature of the mixed gas G is reduced.

It is possible to optionally control the steam density by properly opening and closing the air supply side shutter 51 and the air discharge side shutter 52 to regulate the amount of the outside air to be introduced into the heating chamber 11. Since the steam S generated from the evaporating dish 35 is taken out by boiling the water, a temperature thereof is approximately 100° C. The temperature of the mixed gas G of the steam S and the outside air is equal to or lower than 100° C. By regulating the steam density of the mixed gas G to have an optional value, accordingly, it is possible to control the mixed gas G to have an optimally desirable temperature for the cooking which is equal to or lower than 100° C.

Since the steam S has a lower specific gravity as compared with the outside air, it tends to be moved upward. The mixed gas G having a uniform steam density which is generated in the lower space 11B of the heating chamber 11 is collected into the upper space 11A through a clearance between an edge portion of the tray 22 for mounting an object to be heated and the internal walls of the heating chamber 11 (the side wall surfaces 11*a* and 11*b* and the inner side wall surface 27). Accordingly, the mixed gas G having a lower predetermined temperature than 100° C. is collected into the upper space 11A provided above the tray 22 for mounting an object to be heated through stirring with the outside air so that an atmosphere having a predetermined certain temperature is obtained. More specifically, the lower space 11B functions as a stirring space of the steam S and the outside air so that the upper space 11A becomes a cooking space maintained to have a uniform temperature. In addition, the mixed gas G in which the steam density is caused to be uniform in the lower space 11B is evenly supplied to the upper space 11A along the clearance between the tray 22 for mounting an object to be heated and the internal wall of the heating chamber. Therefore, the inside of the upper space 11A is caused to have a predetermined uniform temperature.

Figure 6:
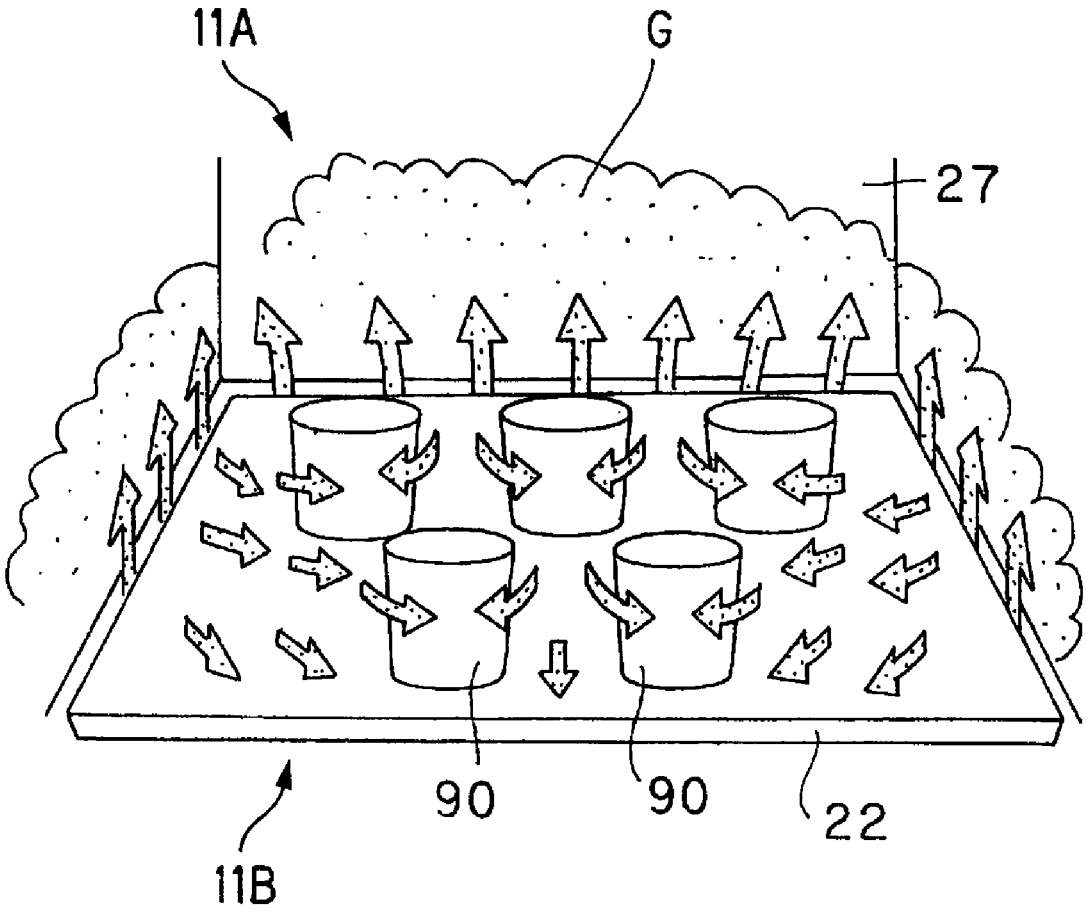
FIG. 6 is an explanatory view showing a state in which a pot-steamed hotchpotch mounted on a tray for mounting an object to be heated is uniformly cooked in the upper space.

FIG. 6 shows a state of the middle of cooking in which a food such as a pot-steamed hotchpotch 90 is mounted on the tray 22 for mounting an object to be heated and is put in the upper space 11A to which the mixed gas G having a uniform steam density is supplied, and the cooking is thus carried out. As shown in FIG. 6, the mixed gas G obtained by sufficiently stirring the steam S and the outside air to have a uniform steam density in the lower space 11B is supplied almost evenly to the upper space 11A to be the cooking space without a concentration from the periphery of the tray 22 for mounting an object to be heated. Accordingly, the upper space 11A is wholly filled with the mixed gas G equally and a temperature distribution is also uniform. Therefore, the food such as the pot-steamed hotchpotch 90 is heated uniformly irrespective of the mounting position on the tray 22 for mounting an object to be heated so that cooking having no heating unevenness is carried out.

According to the cooking device 100 in accordance with the embodiment, the steam S is supplied into the heating chamber 11, while the wind sent from the ventilating means such as the cooling fan 32 or the ventilating fan 60 is introduced into the heating chamber 11 through the ventilating path 81 for air supply, and furthermore, the air in the heating chamber 11 is discharged from the ventilating path 85 for air discharge. Therefore, the steam S supplied into the heating chamber 11 is positively stirred by the outside air so that the inside of the heating chamber 11 can be set to have a desirable atmospheric temperature. In other words, the mixed gas G having the steam S diffused sufficiently into the air in the heating chamber 11 is generated, and the temperature of the mixed gas G is set to be lower than that of the steam S which is supplied. Accordingly, it is possible to set the heating chamber 11 to have an optional temperature which is suitable for the cooking. Thus, the cooking such as egg cooking which requires accurate temperature setting can be carried out rapidly and reliably.

When the heating is carried out with a steam at approximately 100° C., for example, cooking which is particularly hard to manage a temperature such as the egg cooking ends in failure if a heating time is not set accurately. If the steam S is preset to have a suitable temperature for the cooking, however, the cooking can be prevented from ending in failure even if the cooking is continuously carried out for a longer time than an assumed time.

In the cooking device 100, moreover, the dividing plate (the tray for mounting an object to be heated) 22 for vertically dividing the heating chamber 11 is provided and the steam S is supplied to the lower space 11B provided below the dividing plate 22. Consequently, the steam S supplied to the lower space 11B rises and collects into the upper space 11A through the communicating portion between the dividing plate 22 and the wall surface of the heating chamber 11. By this action, the steam S is promoted to be stirred still more so that the steam density in the upper space 11A of the heating chamber 11 is caused to be uniform.

In the cooking device 100, furthermore, the air supply port 82 is provided in the lower space 11B of the heating chamber 11. Therefore, the outside air which is sent is efficiently stirred with the steam S supplied to the same lower space 11B and thus becomes the uniform mixed gas G. Moreover, the air discharge port 86 is provided in the lower space 11B of the heating chamber 11. Therefore, it is possible to prevent the air in the upper space 11A from being suddenly replaced. Thus, it is possible to discharge the air without a hindrance to the steam heating. Moreover, the steam itself has a rising flow. Therefore, it is possible to prevent the flow of the wind from acting on the upper space 11A of the heating chamber 11, resulting in a deterioration in a ventilating action on the upper space 11A.

In the cooking device 100, the steam S is supplied into the heating chamber 11 from the evaporating dish 35 provided in the heating chamber 11. As compared with the case in which a boiler device is provided on the outside of the heating chamber 11, therefore, a structure can be simplified more greatly. The dirt of a scale which is stuck to the evaporating dish 35 can easily be removed so that a sanitary environment can easily be maintained.

In the cooking device 100, furthermore, the air supply side shutter 51 is provided on the upstream side of the passageway of the ventilating path 81 for air supply. Consequently, it is possible to change a flow rate of the ventilating path 81 for air supply and to vary the amount of supply of the outside air of the heating chamber 11. By providing the air discharge side shutter 52 on the downstream side of the passageway of the ventilating path 85 for air discharge, moreover, it is possible to change the flow rate of the ventilating path 85 for air discharge and to vary the amount of discharge of the air from the heating chamber 11.

By freely carrying out a control for opening and closing the shutters 51 and 52 with a simple structure and setting an operation for opening and closing the shutters 51 and 52 to be a duty control, for example, it is possible to optionally set the flow rate of a gas flowing in the passageway. Accordingly, the atmospheric temperature and the steam density in the upper space 11A of the heating chamber 11 to be the cooking space can be set finely and accurately.

In the case in which the steam in the heating chamber 11 is unnecessary immediately before the end of the cooking, the steam is positively discharged from the ventilating path 85 for air discharge. Consequently, it is possible to prevent a hindrance to the take-out of the object to be heated due to the steam in the heating chamber 11, thereby suppressing the generation of a dew.

Also in the middle of the cooking, the steam can be discharged in an optional timing if necessary. Also in the case in which the steam is only required till the middle of the heating, consequently, it is possible to discharge the steam supplied to the heating chamber 11 in a short time. Accordingly, the steam can be prevented from being excessively stuck to the surface of the food, resulting in a deterioration in the result of the food. Thus, cooking combined with the supply of the steam can be freely carried out so that the steam heating function can be enhanced still more.

For example, when a fried food is heated in the steam atmosphere for a longer time than necessary, a coating of a surface excessively contains water by the steam so that an appearance and a feeling of eating are deteriorated. When the steam is not necessary, therefore, the steam remaining in the heating chamber 11 is once discharged so that extra water can be prevented from being stuck to the food. In other words, the heating chamber 11 is heated by means of the upper heater 11, and the steam is supplied into the heating chamber 11, thereby preventing the water from being taken away to dry the food due to the heating. In addition, when the amount of the water in the food is sufficient, it is possible to obtain a proper result by discharging the steam in the heating chamber 11.

In the case in which a temperature of the food is detected by the infrared sensor 18, furthermore, the steam is discharged from the inner part of the heating chamber 11 so that a temperature can be detected accurately. With the structure, furthermore, the steam is discharged under the tray 22 to be the dividing plate. Therefore, it is not necessary to directly blow the wind against the food. Thus, the food can be prevented from being cooled. Moreover, the steam is supplied to the heating chamber space provided under the tray 22 for mounting the food thereon. Therefore, the dew generated by the steam can be prevented from being directly stuck to the food. In other words, when the steam is supplied to the lower space 11B of the heating chamber 11, the steam is cooled by stirring with the air in the lower space 11B to reach a dew point. Consequently, the water exceeding the amount of a saturated steam in the steam is condensed and stuck to the bottom face and the wall surface of the heating chamber 11. In the case in which the food is put in a position placed in contact with the dew, the food is damaged so that the cooking ends in failure. When the food is mounted on the upper surface of the tray 22, however, the food is disposed in the upper space 11A of the heating chamber 11. Consequently, the food can be prevented from being influenced by the dew due to the supply of the steam to the lower space 11B. Thus, an excellent result of the food can be obtained.

Description will be given to an example of cooking in which the pot-steamed hotchpotch 90 is cooked by using the cooking device 100 according to the embodiment.

Figure 7:
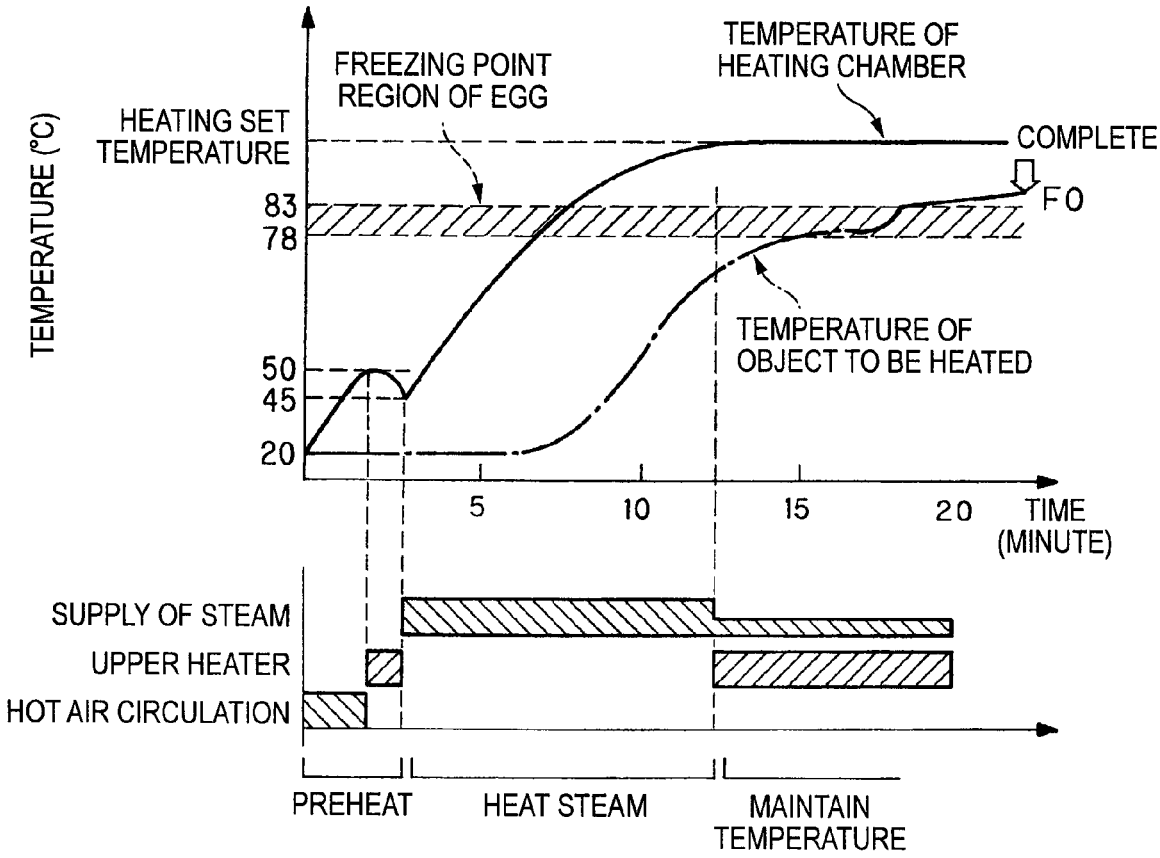
FIG. 7 is an explanatory chart showing an example of cooking in which a control for opening and closing a shutter is not carried out.

FIG. 7 shows a cooking pattern of the pot-steamed hotchpotch through "steam supply+heater heating". There is shown an example of cooking in which the shutters 51 and 52 are fixed in an opening state and a control for air supply and air discharge is not particularly carried out.

First of all, a bowl containing a material which is the object M to be heated is mounted on the tray 22 for mounting an object to be heated (dividing plate) and is put in the heating chamber 11, and the opening door 21 is then closed. The input operating portion 507 is operated to set a heating method, a heating time and a heating temperature, and a start button is pressed down to start cooking.

Based on an instruction given from the control portion 501, the circulating fan 17 is rotated to circulate hot air for a predetermined time (for example, one minute) in the heating chamber 11 while the convection heater 19 is caused to generate heat at a preheating step. In the case in which the tray 22 for mounting an object to be heated which includes a microwave heat generating member) is used, the preheating can also be carried out by means of the magnetron 13 in place of the hot air circulation through the circulating fan 17 and the convection heater 19 or using them together. Subsequently, the upper heater 16 is caused to generate heat and is maintained for a predetermined time (for example, 30 seconds). Consequently, the temperature in the heating chamber 11 is raised to be a preheating temperature of 45° C. to 50° C. Then, the evaporating dish heater 37 is caused to generate heat to heat and evaporate the water in the water reservoir concave portion 35*a* of the evaporating dish 35, thereby generating the steam S. By the steam S supplied to the heating chamber 11, the temperature in the heating chamber 11 is raised gradually so that the temperature of the bowl which is the object M to be heated is also raised more and more.

When the temperature in the heating chamber 11 reaches a preset temperature soon, the amount of supply of the steam S is decreased and the upper heater 16 is caused to generate heat instead. Consequently, it is possible to prevent the amount of the steam from being increased excessively to generate a dew on the door or the wall surface of the heating chamber. Moreover, a portion corresponding to a decrease in the amount of the supply of the steam is supplemented by the heat generation from the upper heater 16 so that the inner part of the heating chamber 11 is maintained to have a predetermined set temperature. At this time, the amount of feed of a power in the supply of the steam is set in such a manner that a sum with the amount of feed of the power to the upper heater 16 does not exceed a range of a rated power. Thus, the heating carried out by the upper heater 16 and the heating carried out by the steam S are used together to continuously perform the heating, thereby maintaining the temperature in the heating chamber 11 to be a set temperature. A temperature on a freezing point for an egg is approximately 78° C. to 82° C. When the temperature of the pot-steamed hotchpotch 90 exceeds a freezing point region, the cooking is ended. A time required for completing the cooking of the pot-steamed hotchpotch 90 is approximately 20 minutes.

In the case in which the cooking is carried out by the steam heating, thus, an amount of an energy to be transferred is larger as compared with the case in which a heat transfer medium is the air as in oven heating because a main heat transfer medium is the steam S. Accordingly, the object M to be heated can be heated more quickly. Moreover, a heat exchange function is excellent. Therefore, the heating can be uniformly carried out from the periphery of the object M to be heated to the inner part. In the cooking of the pot-steamed hotchpotch 90, particularly, it is possible to prevent an insufficient coagulation due to the generation of bubbles and insufficient heating.

Figure 8:
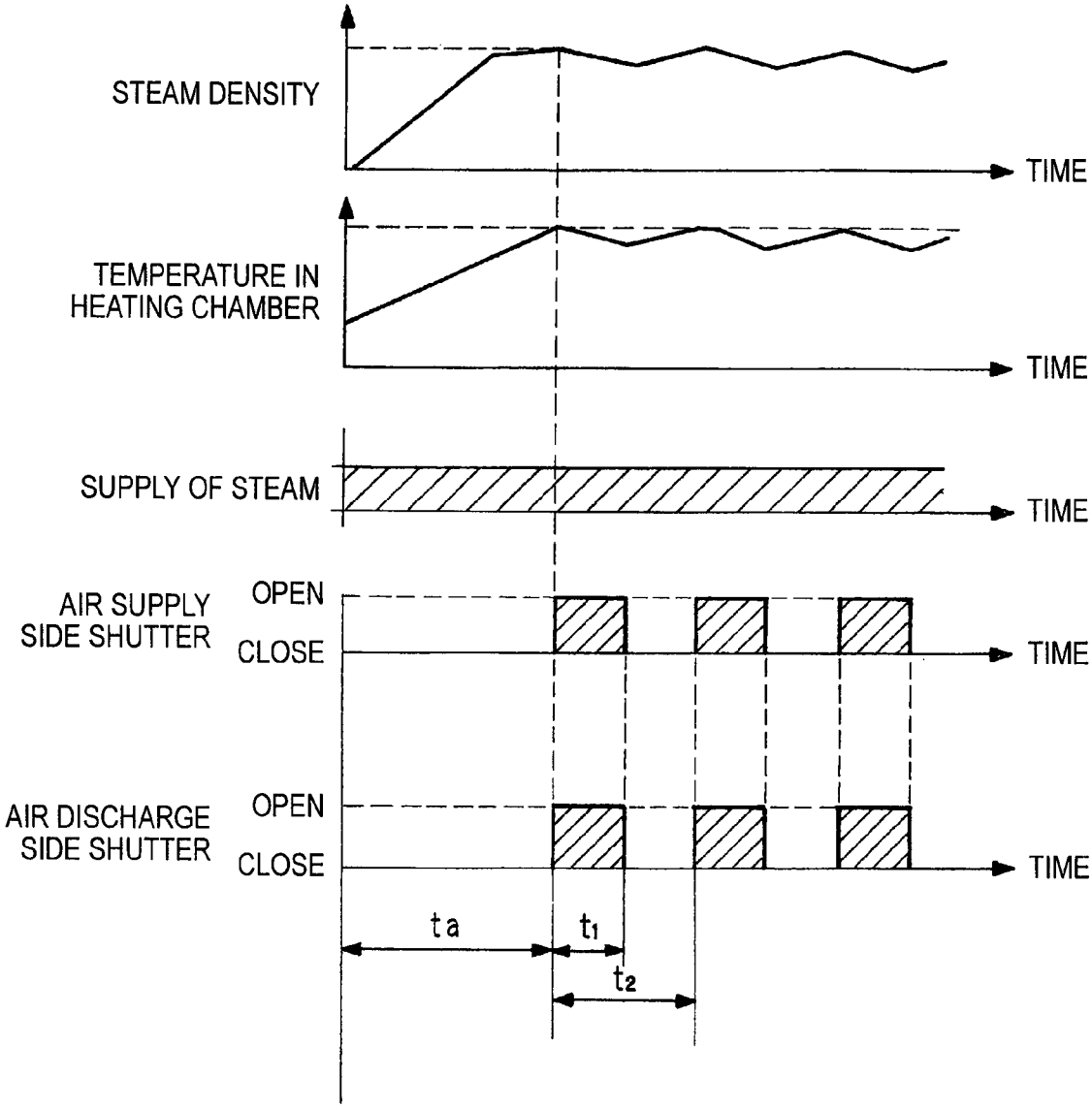
FIG. 8 is an explanatory chart showing an example of the cooking in which the control for opening and closing the shutter is carried out, thereby controlling to supply and discharge air.

With reference to FIG. 8, next, description will be given to an example of the cooking of the pot-steamed hotchpotch 90 which is carried out by the steam supply controlling air supply and air discharge by using the shutters 51 and 52. FIG. 8 shows a cooking pattern obtained by the steam supply which is controlled.

First of all, a bowl containing the material which is the object M to be heated is prepared and the cooking is started in the same manner as described above.

Based on an instruction given from the control portion 501, the evaporating dish heater 37 is caused to generate heat and the water supplied to the water storage concave portion 35*a* of the evaporating dish 35 is heated and evaporated. The heating chamber 11 is filled with the steam S until a saturation state is brought. The air supply side shutter 51 and the air discharge side shutter 52 are closed before the steam is filled. Thus, the heating chamber 11 is set to be a closed space. With the supply of the steam, the temperature of the heating chamber 11 is raised gradually. After a time ta that the temperature of the heating chamber 11 reaches a predetermined temperature, the control for opening and closing the air supply side shutter 51 and the air discharge side shutter 52 is started. More specifically, the air supply side shutter 51 and the air discharge side shutter 52 are opened and the cooling fan 32 (or the ventilating fan 60) is operated to blow the outside air from the air supply port 82 into the heating chamber 11 (see FIG. 4). The steam S filled in the lower space 11B is positively stirred and is caused to be uniform by an air current sent from the air supply port 82. Moreover, a part of the air in the lower space 11B is discharged from the air discharge port 86. Therefore, a stirring effect can be increased still more. Accordingly, the mixed gas G having a uniform steam density is generated in the lower space 11B. The mixed gas G is collected into the upper space 11A.

Figure 9:
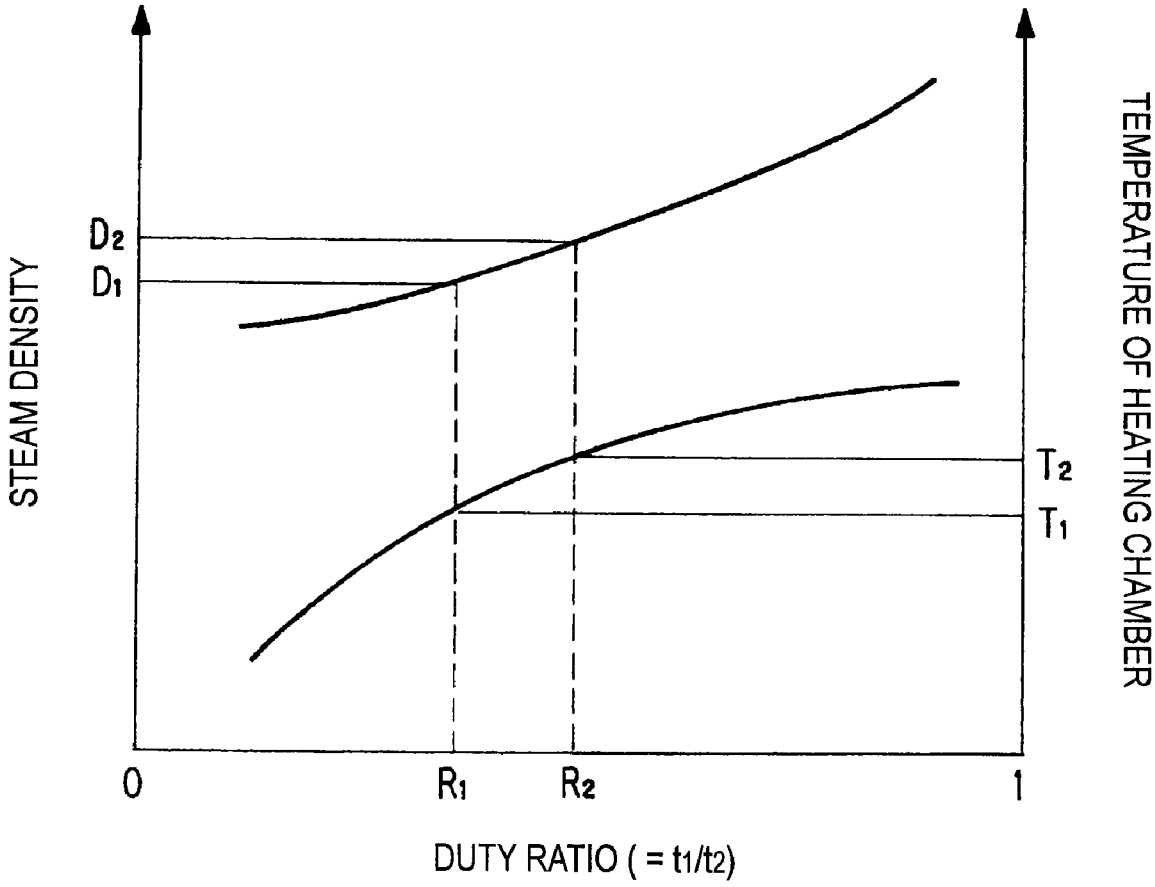
FIG. 9 is a graph showing a relationship between an opening and closing duty ratio of an air supply side shutter and an air discharge side shutter, a steam density and a temperature of a heating chamber.

The temperature of the mixed gas G is equal to or lower than 100° C. By controlling the steam density, it is possible to regulate the atmospheric temperature of the upper space 11A serving as the cooking space to be an optional temperature. The principle of the temperature regulation will be described with reference to FIG. 9. FIG. 9 is a graph showing a relationship between a duty ratio R (t1/t2) of a time t1 that the air supply side shutter 51 and the air discharge side shutter 52 are opened to an opening/closing cycle time t2 of the air supply side shutter 51 and the air discharge side shutter 52 (see FIG. 8), and a steam density and a heating chamber temperature. From FIG. 9, for example, in the case in which the heating chamber temperature is to be set to be T1, the air supply side shutter 51 and the air discharge side shutter 52 are opening/closing controlled at a duty ratio of R1 so that a steam density of D1 can be set and the desirable heating chamber temperature T1 can be thus obtained. In the case in which the heating chamber temperature is raised to be T2, moreover, the duty ratio is set to be R2 so that a steam density of D2 can be set and the desirable heating chamber temperature T2 can be thus obtained.

More specifically, the air supply side shutter 51 and the air discharge side shutter 52 are opening/closing controlled at an aimed duty ratio to regulate the amount of introduction of the outside air while the steam S is continuously generated from the steam supplying portion 15. Consequently, the steam density is changed so that the temperature of the heating chamber is set to be a desirable temperature. When the opening/closing cycle time t2 is excessively prolonged, a range of a change in the temperature is increased even if a mean temperature ranges within a set temperature. When the opening/closing cycle time t2 is shortened, moreover, the range in the change of the temperature is reduced. However, the air supply side shutter 51 and the air discharge side shutter 52 are often opened and closed. For this reason, there is a problem in that a burden to the opening/closing control in the control portion is increased and a durability to the shutter mechanism is reduced. Therefore, it is desirable that the opening/closing cycle time t2 should be set from approximately 1 to 30 seconds. In other words, it is also possible to carry out the control by setting an axis of abscissa in FIG. 9 to indicate an opening/closing cycle time in place of the duty ratio R.

Thus, the mixed gas G having a uniform steam density which is generated in the lower space 11B is collected into the upper space 11A via the clearance between the edge of the tray 22 for mounting an object to be heated and the internal walls (the side wall surfaces 11*a* and 11*b* and the inner side wall surface 27) of the heating chamber 11, thereby setting the upper space 11A to have an atmosphere at a predetermined temperature. Accordingly, the mixed gas G having a uniform steam density is supplied almost evenly, without a concentration, to the pot-steamed hotchpotch 90 mounted on the tray 22 for mounting an object to be heated. Therefore, each of the pot-steamed hotchpotches 90 and an inner part of the pot-steamed hotchpotch 90 are heated uniformly.

The air supply side shutter 51 and the air discharge side shutter 52 are not restricted to be held in an opening state or a shielding state but may optionally set a degree of opening of each of the ventilating path 81 for air supply and the ventilating path 85 for air discharge.

Next, description will be given to an embodiment of the shutter opening/closing driving portion in which the degree of opening can be freely set.

Figure 10:
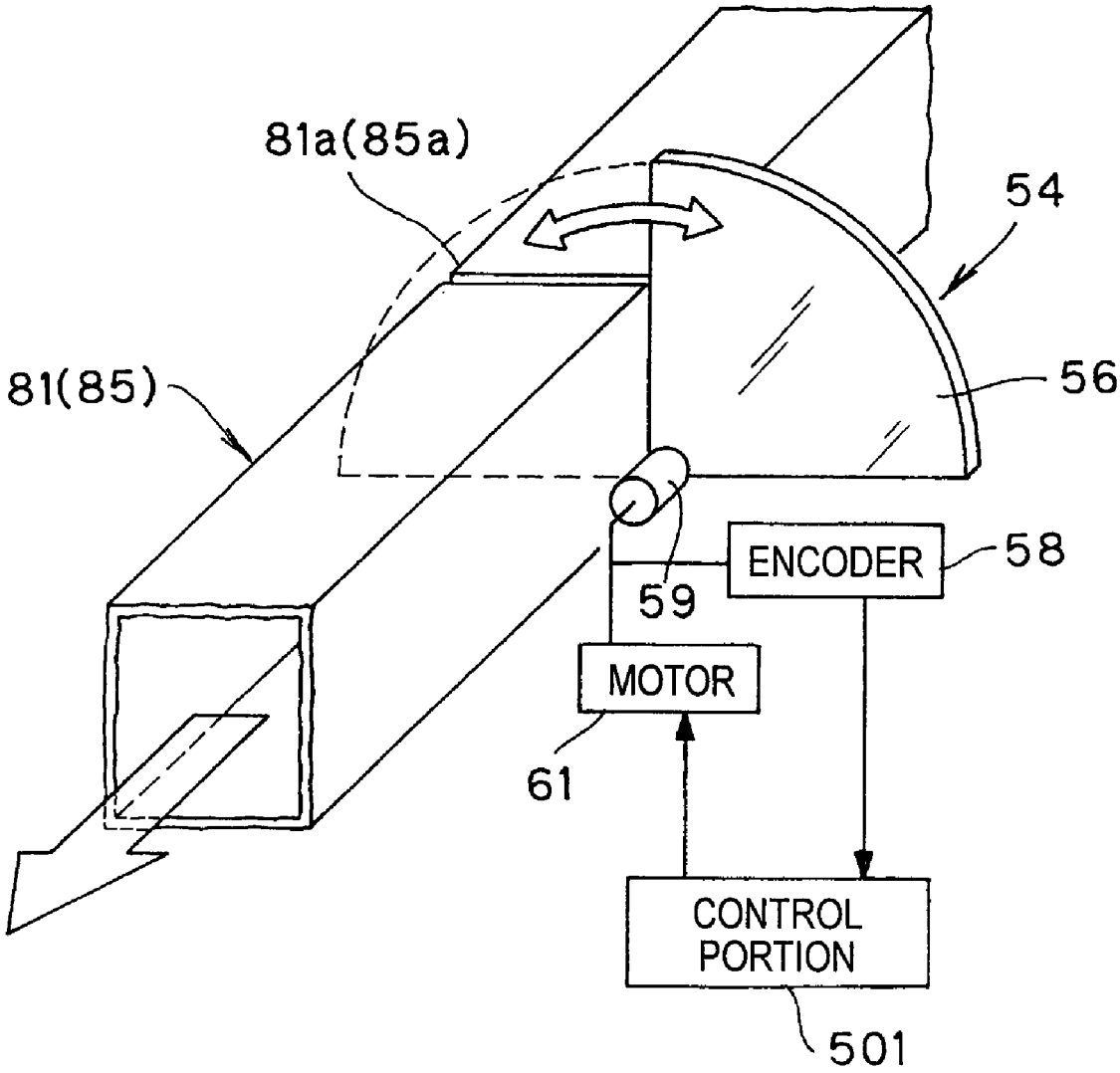
FIG. 10 is a conceptually perspective view showing a main part of a shutter opening and closing driving portion in which the amount of shutter opening and closing is variable.

FIG. 10 is a perspective view showing a main part of the shutter opening/closing driving portion. A shutter opening/closing driving portion 54 is constituted by a fan-shaped shutter 56 formed to be rockable with a shaft 59 to be a rotating center, a motor 61 for rocking and driving the fan-shaped shutter 56, an encoder 58 for detecting a rocking angle of the fan-shaped shutter 56, and the control portion 501 for inputting a detection signal from the encoder 58 and controlling the rotation of the motor 61. A slit 81*a* (85*a*) is formed in the middle of the ventilating path 81 for air supply (the ventilating path 85 for air discharge) and the fan-shaped shutter 56 is rocked and inserted into the slit 81*a* (85*a*), thereby opening and closing the ventilating path 81 for air supply (the ventilating path 85 for air discharge). An opening/closing angle of the fan-shaped shutter 56 can be controlled to be an optional angle based on a rotating angle detection signal sent from the encoder 58. According to the shutter opening/closing driving portion 54 in accordance with the embodiment, therefore, a result of a temperature measurement which is obtained by the infrared sensor 18 and the thermistor 20 is fed back to control the opening/closing angle of the fan-shaped shutter 56. Consequently, the temperature in the heating chamber 11 can be managed with higher precision. In other words, it is possible to carry out the control by setting the axis of abscissa in FIG. 9 to indicate a degree of opening of the ventilating path in place of the duty ratio R.

Figure 11:
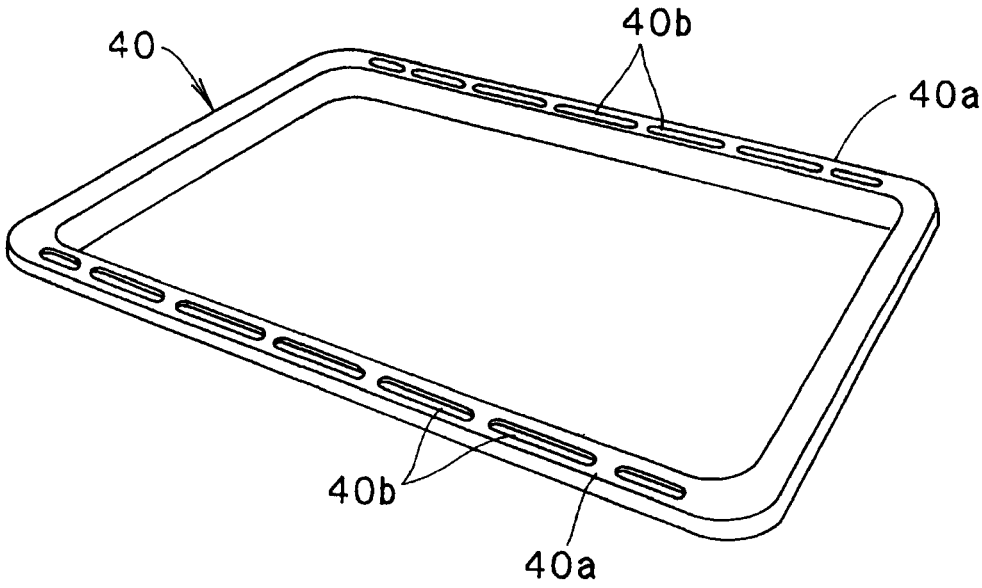
FIG. 11 is a perspective view showing a variant of the tray for mounting an object to be heated.
Figure 12:
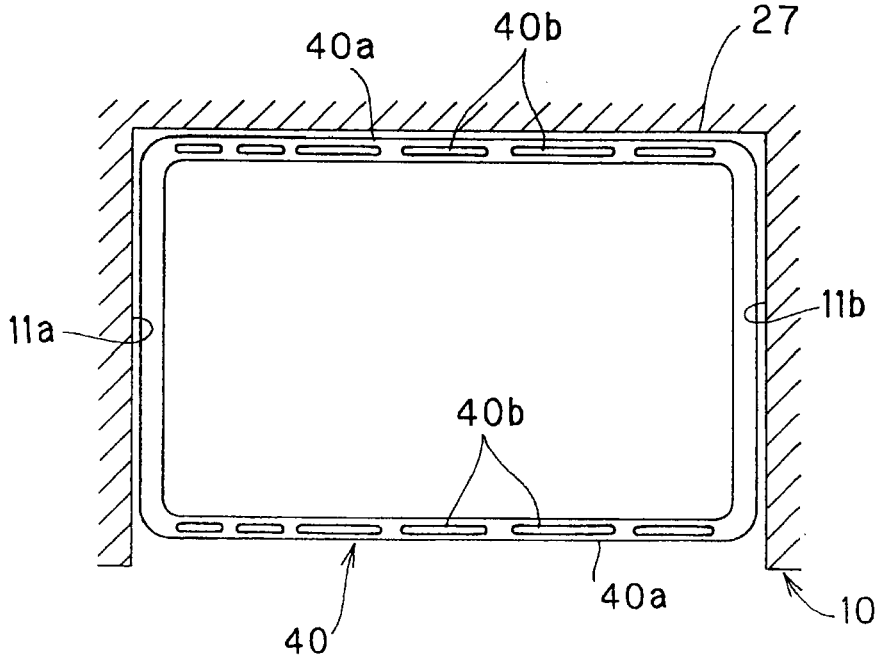
FIG. 12 is a cross-sectional view showing a main part, illustrating a state in which the tray for mounting an object to be heated in FIG. 11 is accommodated in the heating chamber.

With reference to FIGS. 11 and 12, next, description will be given to a variant of the tray for mounting an object to be heated.

FIG. 11 is a perspective view showing the variant of the tray for mounting an object to be heated, and FIG. 12 is a cross-sectional view showing a state in which the tray for mounting an object to be heated is accommodated in the heating chamber. As shown in FIGS. 11 and 12, in a tray 40 for mounting an object to be heated which serves as a dividing plate, a plurality of openings 40*b* penetrating vertically is formed on an edge portion 40*a* on inner and this sides when the tray 40 is accommodated in the heating chamber 11. It is sufficient that the opening 40*b* is provided in an opposed position to the steam supply portion 15 and does not need to be formed on both the inner and this sides. By providing the opening 40*b* on both of them, however, it is possible to attach the tray 40 to the heating chamber 11 without being conscious of the direction of the tray 40 for mounting an object to be heated. Thus, a handling property can be enhanced.

Figure 13:
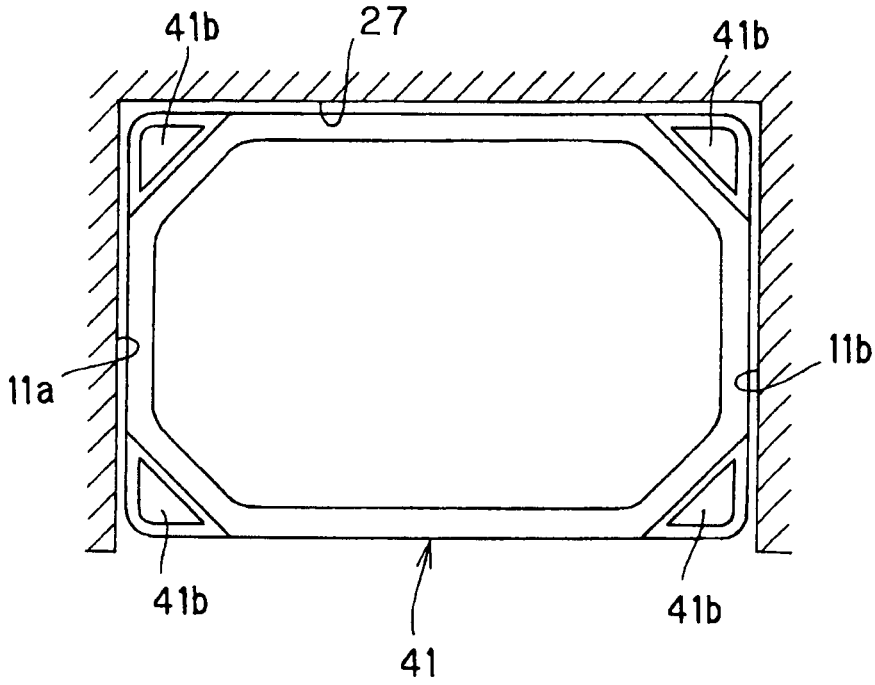
FIG. 13 is a plan view showing a tray for mounting an object to be heated according to another variant.

As another variant, as shown in FIG. 13, an opening 41*b* is formed on four corners of a rectangular tray 41 for mounting an object to be heated. The position of the opening 41*b* is placed on four corners. Consequently, the handling property of the tray 41 for mounting an object to be heated can be enhanced, and furthermore, a mounting space is increased in a direction of a depth. Therefore, it is possible to relieve a drawback that the number of vessels to be mounted is greatly limited depending on the shape of the vessel.

In the structure in which the openings 40*b* and 41*b* are formed on the trays 40 and 41 for mounting an object to be heated so that the heating chamber 11 is vertically divided by the trays 40 and 41 for mounting an object to be heated (dividing plates) to utilize the upper space 11A of the heating chamber 11 as a space for steam heating, thus, a communication state of the upper space 11A and the lower space 11B is reliably maintained by the openings 40*b* and 41*b* even if the air supply port 82 and the air discharge port 86 are provided in the lower space 11B of the heating chamber 11 and the trays 40 and 41 for mounting an object to be heated are disposed in the heating chamber 11 in a hitting state against the inner side wall surface 27.

Consequently, the mixed gas G generated by stirring the steam and the outside air in the lower space 11B of the heating chamber 11 is reliably supplied to the upper space 11A through the openings 40*b* and 41*b* of the trays 40 and 41 for mounting an object to be heated. Accordingly, it is possible to heat the whole object M to be heated in such an atmosphere that it is surrounded by the steam S without strongly blowing the mixed gas G locally against the object M to be heated which is mounted on the trays 40 and 41 for mounting an object to be heated. Moreover, the rising flow of the steam S penetrates through the upper and lower spaces by the openings 40*b* and 41*b* of the trays 40 and 41 for mounting an object to be heated. Consequently, the steam S can be prevented from staying in the upper space 11A so that a ventilation efficiency can also be enhanced.

Referring to the steam heating to be carried out over the object M to be heated, thus, the power of the steam flow is reduced to cause the temperature distribution of the object M to be heated in the steam heating to be uniform, and the steam is previously stirred with the outside air in the lower space 11B in such a manner that the temperature of the steam supplied to the upper space 11A is uniform. Thus, it is possible to implement the stable supply of the steam at a certain temperature.

Figure 14:
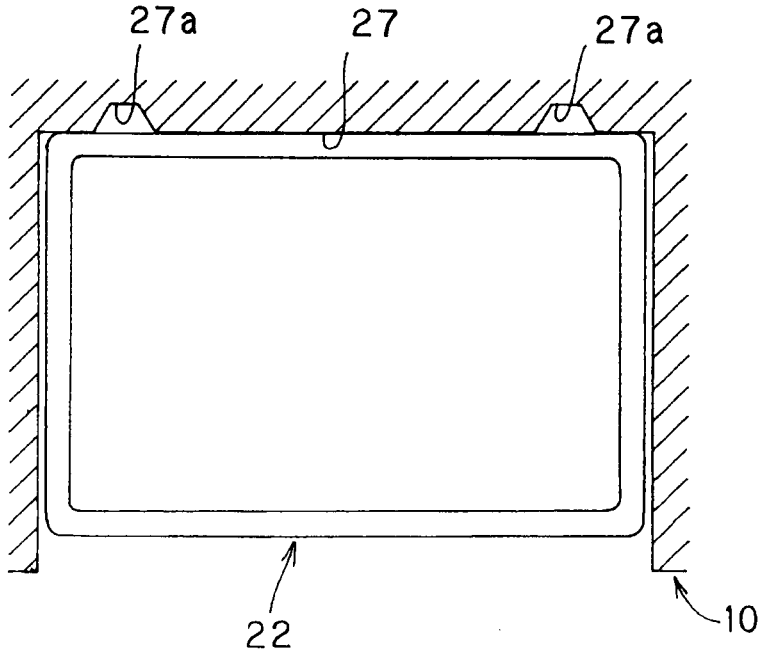
FIG. 14 is a cross-sectional view showing a main part, illustrating a state in which the tray for mounting an object to be heated is accommodated in a heating chamber having a concave trench portion provided on a wall surface at an inner side.

Moreover, the heating chamber 11 shown in FIG. 14 has a concave trench portion 27*a* formed in two places of the inner side wall surface 27 in a perpendicular direction by a press work for a metal plate. Even if the tray 22 for mounting an object to be heated which has no opening formed thereon is disposed in the heating chamber 11, consequently, the upper space 11A and the lower space 11B are caused to communicate with each other through the concave trench portion 27*a*. Also in this case, accordingly, the same advantages as described above can be obtained.

Figure 15:
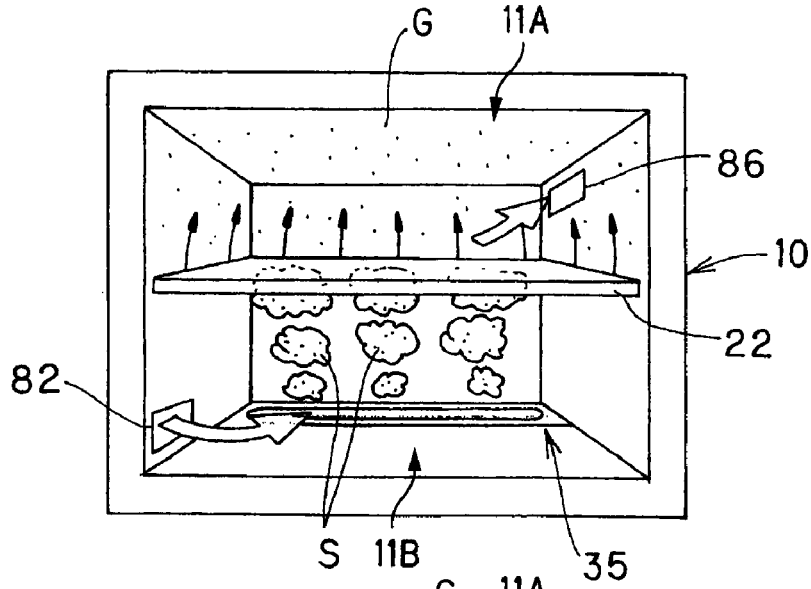
FIG. 15 is a view showing a variation of positions in which an air supply port and an air discharge port are disposed, (a) being a perspective view showing a heating chamber in which the air supply port is disposed in a lower space and the air discharge port is disposed in an upper space, (b) being a perspective view showing a heating chamber in which the air supply port is disposed in the upper space and the air discharge port is disposed in the lower space, and (c) being a perspective view showing a heating chamber in which both the air supply port and the air discharge port are disposed in the upper space.
Figure 15:
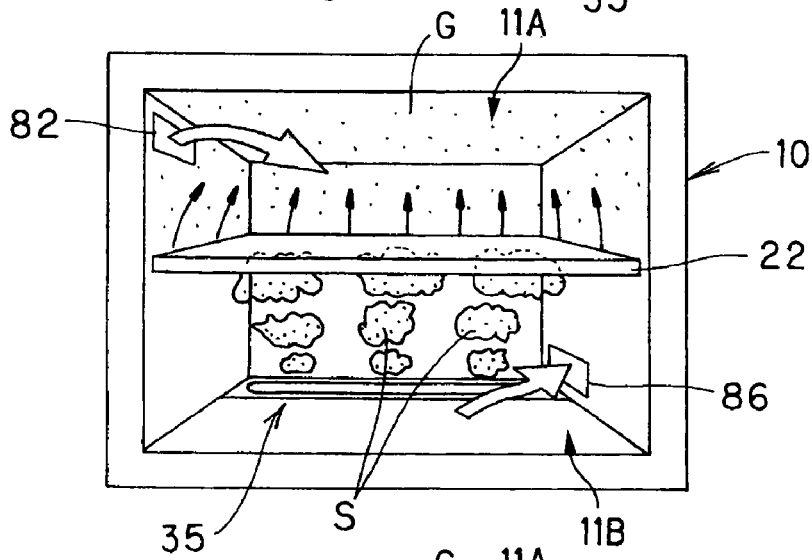
Figure 15:
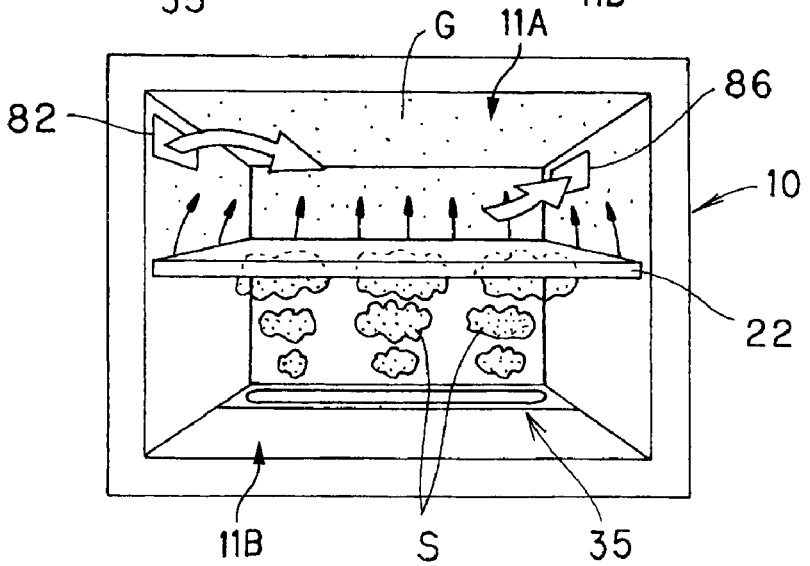
Figure 16:
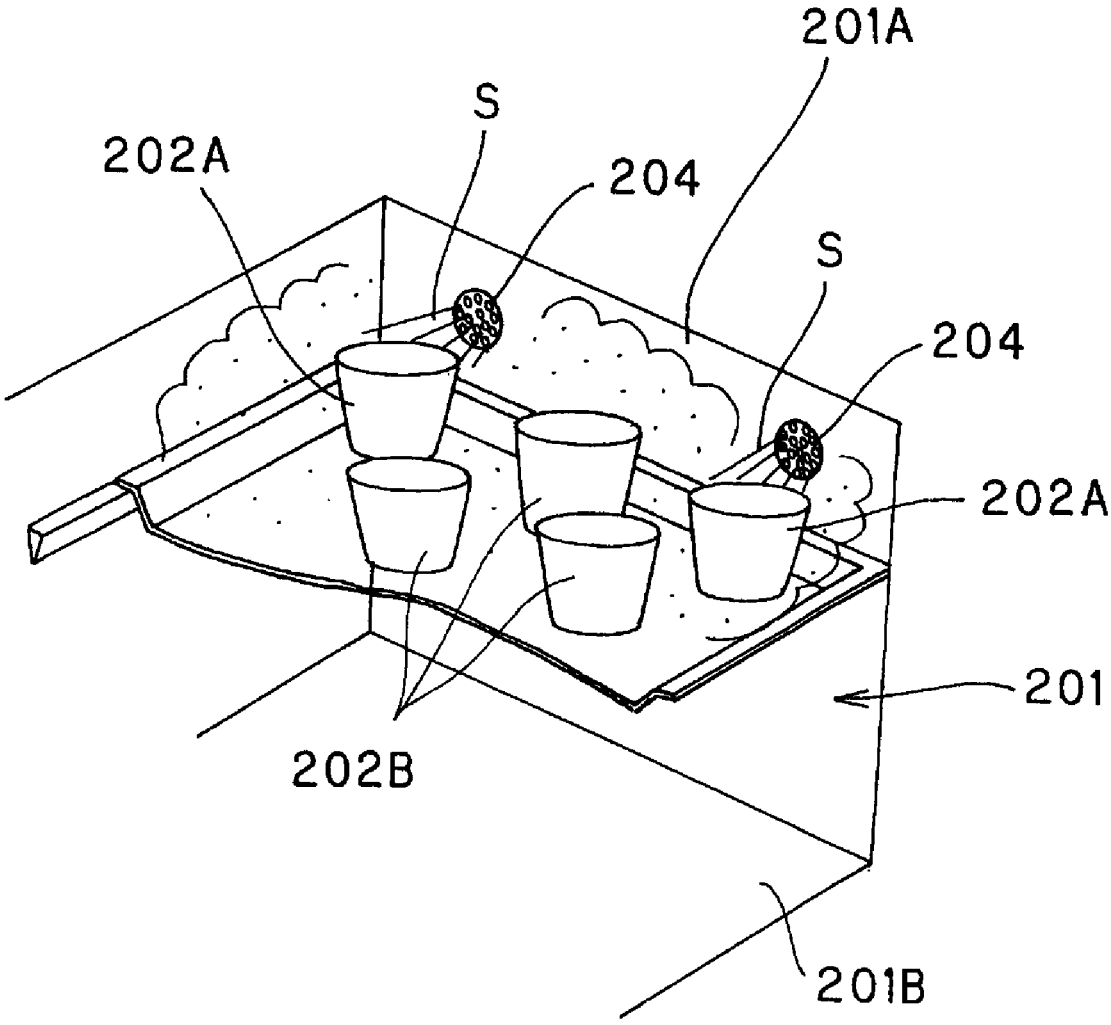
FIG. 16 is an explanatory view showing a conventional heating chamber, illustrating a state in which a steam supplied from a steam supply port is directly blown against a pot-steamed hotchpotch to carry out cooking.
Figure 17:
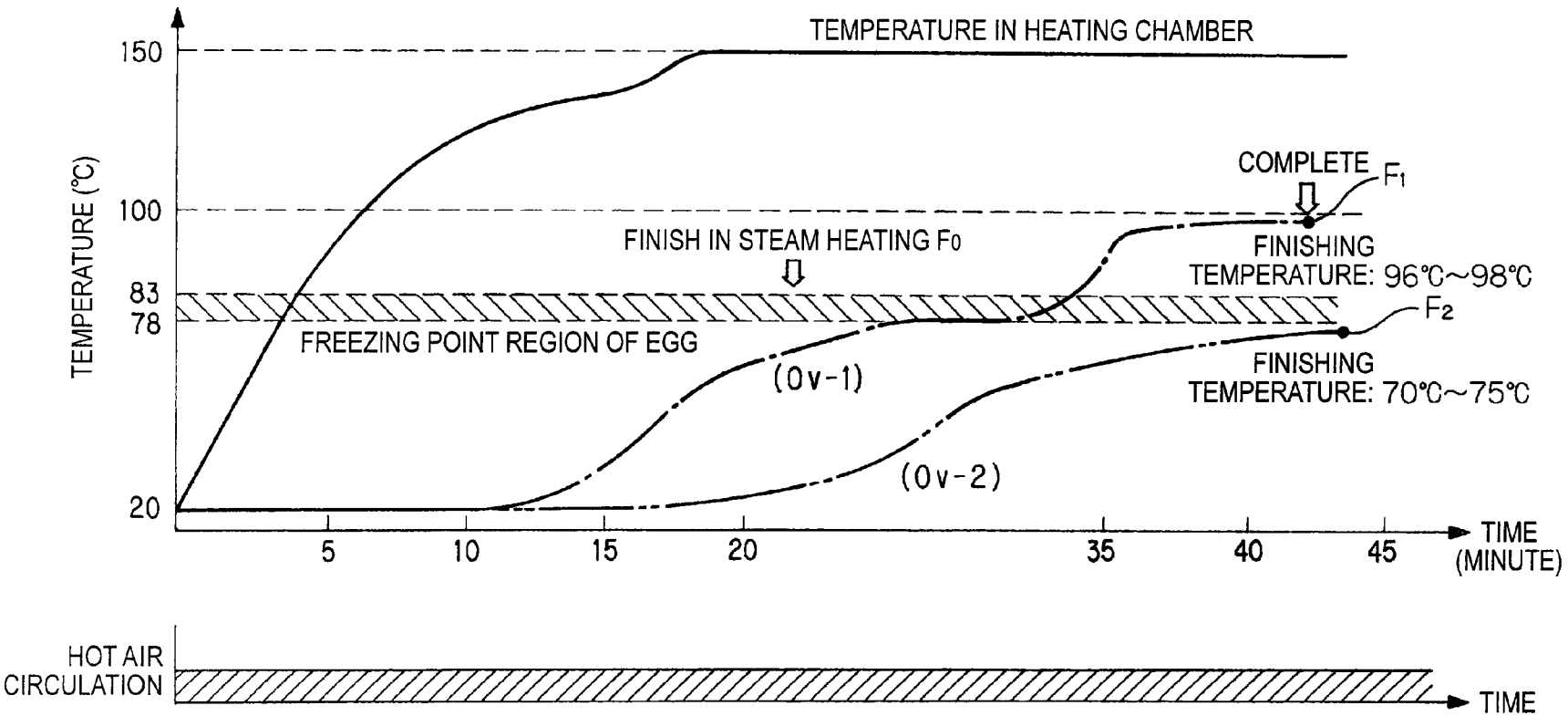
FIG. 17 is a chart showing an example of a conventional cooking pattern in which hot air having a high temperature is circulated in the heating chamber, thereby carrying out cooking.
Figure 18:
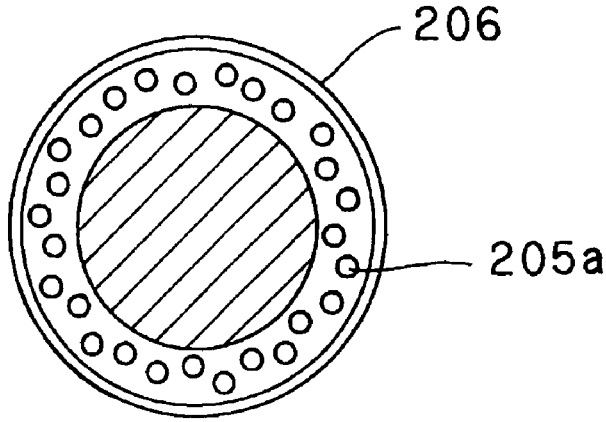
FIG. 18 is a plan view showing a pot-steamed hotchpotch in which a periphery of a vessel is brought into a bubble state by conventional cooking.
Figure 19:
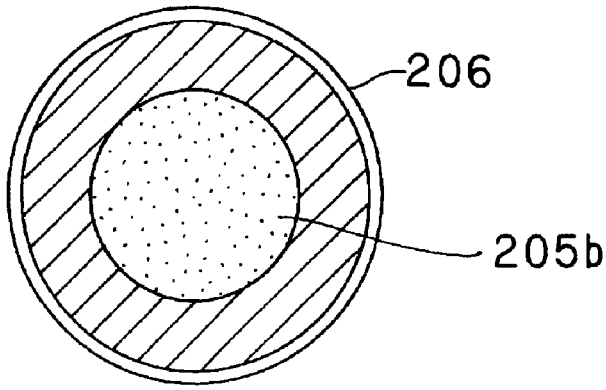
FIG. 19 is a plan view showing a pot-steamed hotchpotch in a state in which a central part is neither heated nor hardened by the conventional cooking.

With reference to FIG. 15, next, description will be given to a variation of the positions in which the air supply port 82 and the air discharge port 86 are disposed.

In FIG. 15(*a*), the air supply port 82 is disposed in the lower space 11B, and furthermore, the air discharge port 86 is disposed in the upper space 11A. According to the heating chamber 11 in accordance with the example of the arrangement, the outside air is introduced from the air supply port 82 into the lower space 11B and the steam S generated from the evaporating dish 35 is positively stirred so that the mixed gas G having a uniform steam density is generated, and furthermore, the hot mixed gas G in the upper space 11A to be the cooking space can be discharged rapidly from the air discharge port 86 after the completion of the cooking, and the heated object M can be taken out of the heating chamber 11 immediately after the completion of the cooking.

In FIG. 15(*b*), the air supply port 82 is disposed in the upper space 11A, and furthermore, the air discharge port 86 is disposed in the lower space 11B. According to the example of the arrangement, the hot mixed gas G in the upper space 11A to be the cooking chamber is first transferred to the lower space 11B after the completion of the cooking, and the air is then discharged from the air discharge port 86. Consequently, the temperature in the upper space 11A can quickly be reduced and the heated object M can easily be taken out after the completion of the cooking.

In FIG. 15(*c*), both the air supply port 82 and the air discharge port 86 are disposed in the upper space 11A. According to the example of the arrangement, the outside air is directly introduced into the upper space 11A to be the cooking space and the air is immediately discharged from the air discharge port 86. Therefore, the air discharging efficiency of the hot mixed gas G is high and the heated object M obtained after the completion of the cooking can easily be taken out.

While the invention has been described in detail with reference to the specific embodiment, it is apparent to the skilled in the art that various changes and modifications can be made without departing from the spirit and scope of the invention.

The application is based on Japanese Patent Application JP-A-2004-033411 filed on Feb. 10, 2004 and the contents thereof are incorporated herein by reference.

INDUSTRIAL APPLICABILITY

As described above, according to the cooking device and the cooking method in accordance with the invention, a steam supplied into a heating chamber can be quickly discharged from the heating chamber, and furthermore, the steam in the heating chamber is set to have a suitable temperature for cooking so that an object to be heated can be cooked by uniform steam heating.

The invention claimed is:

1. A cooking device for supplying a steam into a heating chamber accommodating an object to be heated, thereby heating the object to be heated, comprising:

steam supplying means for supplying the steam to the heating chamber;

air discharging means for discharging the steam supplied to the heating chamber from the heating chamber; and a dividing plate for vertically dividing a space in the heating chamber into upper and lower spaces, wherein said discharging means includes:

a ventilating means which sucks an outside air and generates an air flow, a supply ventilating path which serves to lead the air flow from the ventilating means to the heating chamber, a discharge ventilating path which serves to discharge air in the heating chamber, and a control portion which controls an amount of the outside air to be supplied to the heating chamber;

wherein a communication portion is formed between the heating chamber and the dividing plate to communicate the upper and lower spaces, and said steam supplying means supplies the steam to the lower space of the heating chamber;

an air supply port at where the supply ventilating path is connected to the heating chamber is formed in the lower space of the heating chamber; and an air discharge port at where the discharge ventilating path is connected to the heating chamber is formed in the lower space of the heating chamber and communicates with an outside environment.

2. The cooking device according to claim 1, further comprising an air supply side shutter for limiting a flow rate of passage on an upstream side of a passageway from a connecting position to the heating chamber in the supply ventilating path.

3. The cooking device according to claim 1, further comprising an air discharge side shutter for limiting a flow rate of passage on a downstream side of the passageway from a connecting position to the heating chamber in the discharge ventilating path.

4. The cooking device according to claim 2, wherein the shutter is selectively held in either an opening state or a shielding state of the passageway.

5. The cooking device according to claim 2, wherein the shutter can optionally set a degree of opening of the passageway.

6. A cooking method for supplying a steam to a heating chamber accommodating an object to be heated, thereby heating the object to be heated, the heating chamber being divided into upper and lower spaces by a dividing plate, the method comprising the steps of:

providing the cooking device according to claim 1;

supplying a steam and an outside air to the lower space of the heating chamber to generate a mixture air;

supplying the mixture air to the upper space of the heating chamber through a communication formed between the heating chamber and the dividing plate to communicate the upper and lower spaces; and discharging air in the heating chamber from the lower space of the heating chamber to an outside environment.

7. The cooking device according to claim 3, wherein the shutter is selectively held in either an opening state or a shielding state of the passageway.

8. The cooking device according to claim 3, wherein the shutter can optionally set a degree of opening of the passageway.

9. The cooking device according to claim 1, further comprising an air supply side shutter for limiting a flow rate of passage on an upstream side of a passageway from a connecting position to the heating chamber in the supply ventilating path, and an air discharge side shutter for limiting a flow rate of passage on a downstream side of the passageway from a connecting position to the heating chamber in the discharge ventilating path, wherein said control portion controls operations of the air supply side shutter and the air discharge side shutter.

10. The cooking device according to claim 9, wherein said control portion controls operations of the air supply side shutter and the air discharge side shutter so as to generate a mixture air of the steam and the outside air, temperature of which is less than 100° C. in the lower space of the heating chamber.

* * * * *